United States Patent [19]

Haruta

[11] Patent Number: 5,062,519

[45] Date of Patent: Nov. 5, 1991

[54] ESCALATOR SYSTEM WITH CONVERTIBLE STEP UNIT

[75] Inventor: Yasumasa Haruta, Inazawa, Japan

[73] Assignee: Mitsubishi Denki Kabushiki Kaisha, Japan

[21] Appl. No.: 530,797

[22] Filed: May 30, 1990

[30] Foreign Application Priority Data

May 31, 1989 [JP] Japan ..... 1-137637
May 31, 1989 [JP] Japan ..... 1-137638

[51] Int. Cl.[5] ..... B66B 23/12
[52] U.S. Cl. ..... 190/333
[58] Field of Search ..... 198/333, 321, 326

[56] References Cited

U.S. PATENT DOCUMENTS 4,557,369 12/1985 Ishida et al. ..... 198/333
4,681,207 7/1987 Goto et al. ..... 198/333
4,863,006 9/1989 Kotkata et al. ..... 198/333 X

FOREIGN PATENT DOCUMENTS 6319437 7/1983 Japan .
6319438 7/1983 Japan .
6361266 8/1983 Japan .
6323113 12/1983 Japan .
100989 4/1990 Japan ..... 198/333

*Primary Examiner*—Joseph E. Valenza
*Assistant Examiner*—Keith Dixon
*Attorney, Agent, or Firm*—Leydig, Voit & Mayer

[57] ABSTRACT

An escalator system comprising a main frame (1) defining a circulating loop path (2) therein, a plurality of steps (3,4,5,6) connected in an endless step loop disposed in the loop path and a special convertible step unit (4,5,6) disposed in the step loop and having a movable member (4a,11). The special step unit defines at least one of the steps with the movable member in an ordinary position in an ordinary operating mode, and the step unit defining a special step having a broad tread surface with the movable member displaced in a broad step position in a special operating mode. A displacement mechanism (45,46,13) having one end engageable with the special step unit (7) is disposed for displacing the movable member of the special step unit between the ordinary position and the broad step position by a drive force of the step loop which is a drive force component in the direction of width of the step. The other end of the displacement mechanism is engageable with a guide rail (27) only in the special operating mode for moving the displacement mechanism in the step width direction by a camming action of the guide rail.

15 Claims, 18 Drawing Sheets

ESCALATOR SYSTEM WITH CONVERTIBLE STEP UNIT

BACKGROUND OF THE INVENTION

This invention relates to an escalator system with a convertible step unit and, more particularly, to an escalator system having convertible steps for receiving thereon a wheel chair or the like for the handicapped.

The examples of the conventional designs of the escalator to which the present invention pertaines can be found in Japanese Patent Publication No. 63-19437 in which a tread board of some of the steps is moved up and downwardly at the landings, Japanese Patent Laid-Open No. 63-61266 in which one portion of the tread board is moved up and down between an inclided position and a horizontal position, and Japanese Patent Publication No. 63-19438 wherein a wheel stopper is raised above the tread surface, and these special steps are connected in an endless loop of ordinary steps to be circulatingly driven along a circulating path disposed in an escalator main frame.

During ordinary mode of operation of the above-discussed escalator system, the special, convertible steps serve as ordinary steps to carry passengers. During the wheel chair carrying mode of operation, the movable member such as the movable tread board, the wheel stopper and the drop-down tread board mounted on the convertible steps are brought into the respective operated position to carry the wheel chair. In order to convert the mode of operation of the convertible steps of the conventional escalator system between the ordinary mode and the wheel-chair carrying mode, the escalator must be stopped when the convertible steps are at the upper or lower lading to actuate the movable members between the actuated and inactuated positions, decreasing the transportation capacity of the escalator system and requiring some maneuver.

SUMMARY OF THE INVENTION

Accordingly, one object of the present invention is to provide an escalator system with a convertible step unit free from the above-discussed problems of the conventional escalator.

Another object of the present invention is to provide an escalator system with a convertible step unit which has a higher operating efficiency.

Another object of the present invention is to provide an escalator system with a convertible step unit which can be converted between two operational modes without stopping the escalator system.

Still another object of the present invention is to provide an escalator system with a convertible step unit in which the conversion between two operational modes can automatically be made.

A further object of the present invention is to provide an escalator system with a convertible step unit in which the conversion between two operational modes can smoothly be made without generating shocks or vibrations.

With the above objects in view, the escalator system of the present invention comprises a main frame defining a circulating loop path therein, a plurality of steps connected in an endless step loop disposed in the loop path and a convertible step unit disposed in the step loop and having a movable member. The convertible step unit defines at least one of the steps with the movable member in an ordinary position in an ordinary operating mode, and the step unit defining a convertible step having a broad tread surface with the movable member displaced in a broad step position in a convertible operating mode. A displacement mechanism having one end engageable with the convertible step unit is disposed for displacing the movable member of the convertible step unit between the ordinary position and the broad step position by a drive force of the step loop which is a drive force component in the direction of width of the step. The other end of the displacement mechanism is engageable with a guide rail only in the spacial operating mode for moving the displacement mechanism in the step width direction by a camming action of the guide rail.

The displacement mechanism may comprise a movable body having one end engageable with the guide rail to be displaced in the width direction of the step, and a drive force transmission mechanism, having one end engageable with the movable body and the other end engageable with the movable member of the convertible step unit, for being rotated by the displacement of the movable body in the step width direction to cause the displacement of the movable member.

In a preferred embodiment of the present invention, the convertible step unit may comprise a first convertible step for defining the broad tread surface with a first movable member displaced, a second convertible step disposed adjacent to an upper level side of the first step for defining an inclined tread surface with a second movable member displaced. The convertible step unit may further comprise a third convertible step having a main body and a tread board liftably mounted to the main body, a fourth convertible step disposed adjacent to the upper side of the third convertible step and causing a displacement of the movable member for defining a flat broad tread surface together with the tread board of the third convertible step.

The guide rail may be translatingly movable into and out of engagement with the other end of the displacement mechanism in the broad tread operation mode, or may be rotatably movable into and out of engagement with the other end of the displacement mechanism in the broad tread operation mode.

DESCRIPTION OF THE DRAWINGS

The present invention will become more readily apparent from the following detailed description of the preferred embodiment of the present invention taken in conjunction with the accompanying drawings, in which.

DESCRIPTION OF THE PREFERRED EMBODIMENTS

Figure 1:
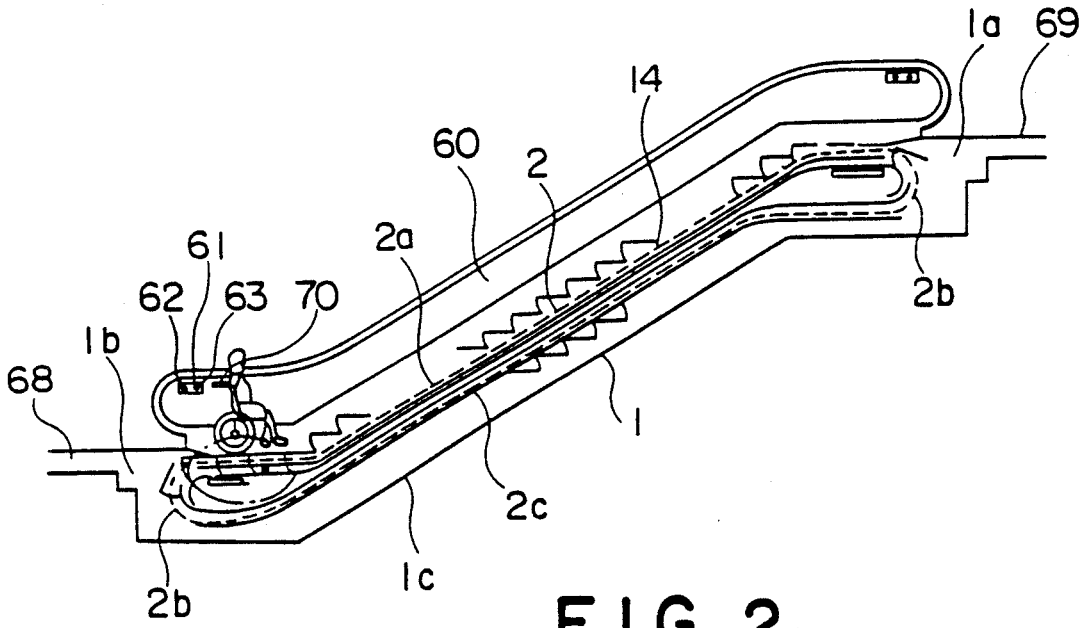
FIG. 1 is a schematic sectional side view illustrating one embodiment of the escalator system with a convertible step unit of the present invention.

In FIGS. 1 to 4, the escalator system of the present invention comprises a main frame 1 including a horizontal upper and lower end portions 1*a* and 1*b* and an intermediate sloped portion 1*c* connecting between the end portions 1*a* and 1*b*. The main frame 1 has disposed thereon an endless circulating loop path defined mainly by guide rails mounted to the main frame 1. The circulating path 2 has a load-bearing run 2*a* on the upper side of the main frame 1, turn-around portions 2*b* at the upper and the lower end portions 1*a* and 1*b* and return run 2*c* on the bottom side of the main frame 1. The escalator system also comprises a plurality of ordinary steps 3 connected along the circulating path 2, a convertible step unit 7 for receiving a wheel chair thereon having special or convertible steps 4, 5 and 6 connected in series in the named order. The convertible step unit 7 is inserted between the ordinary steps 3. It is seen that a step 8 disposed adjacent to the convertible step 4 has mounted thereon an actuator 8*a* for the purpose which will become apparent later on. The first convertible step 4 on the front side of the convertible step unit 7 when the steps are ascending comprises a drop-down tread board 4*a*, the second convertible step 5 next to the first convertible step 4 comprises a fork 11 and the third convertible step 6 on the rear side of the step unit 7 comprises a movable tread board 52*d* and a wheel stopper 12. In order to operate these movable members 4*a*, 11, 52*d* and 12, a drive force transmission mechanism 13 is mounted to each of the convertible steps 4, 5 and 6. All the steps including the convertible steps 4, 5 and 6 as well as the step 8 have step axles connected at the opposite ends thereof to endless step chains 14 which are connected to a drive unit (not shown) so that they are driven along the circulating path 2.

As illustrated in FIGS. 1 to 18 inclusive, each step has mounted on its front portion a step axle 15 having a front roller 16 at the opposite ends thereof and has on its lower, rear portion a rear rollers 17. Each of the steps 3, 4, 5, 6 and 8 is connected at the step axle 15 to the endless step chains 14 and is supported at the front and the rear rollers 16 and 17 by guide rails 18 and 19 mounted to the main frame 1 for the guided ascending and descending movements along the circulating path 2.

Figure 6:
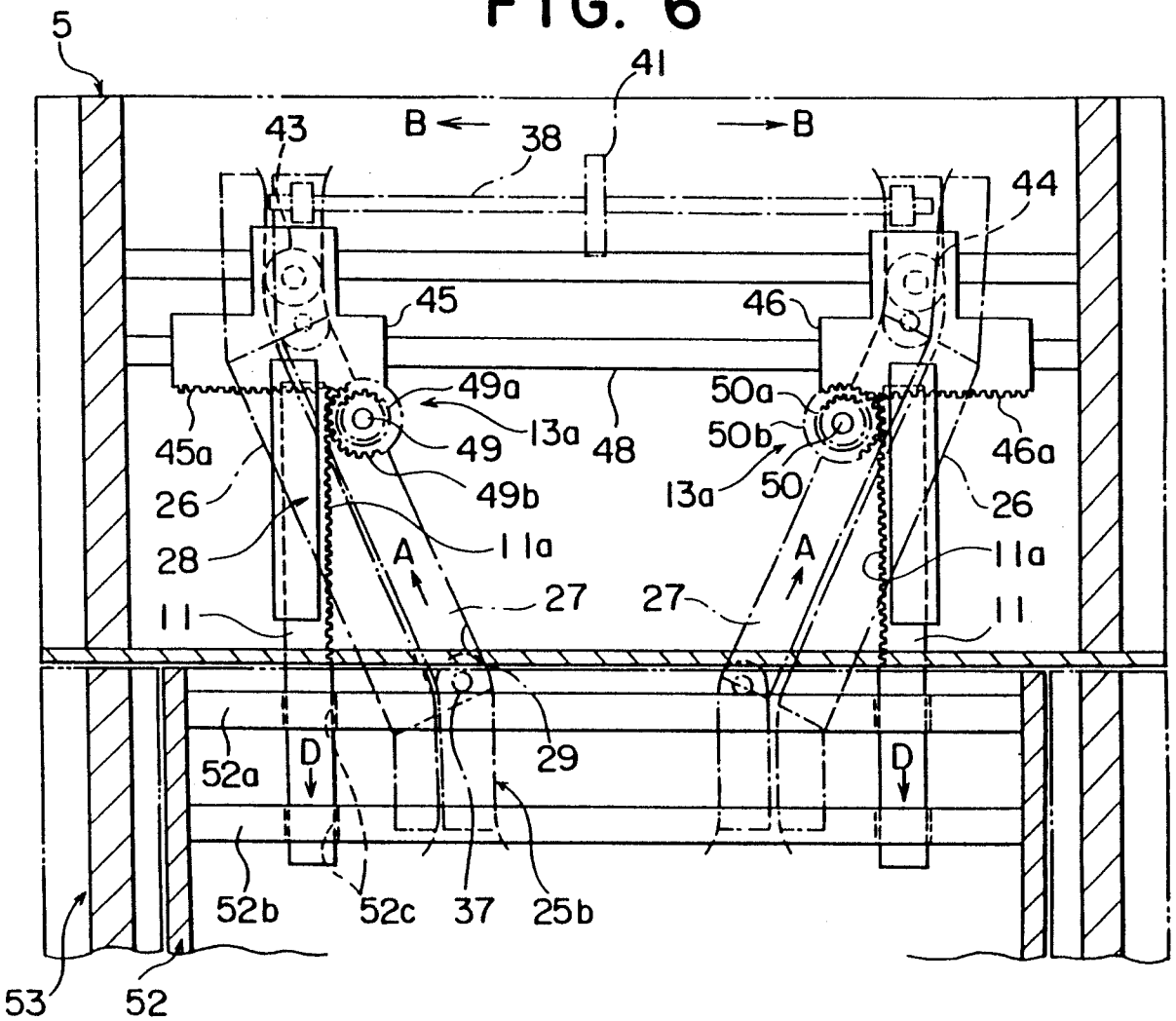
FIG. 6 is a sectional plan view of the convertible step illustrated in FIG. 5 with the fork in its actuated extended position.
Figure 7:
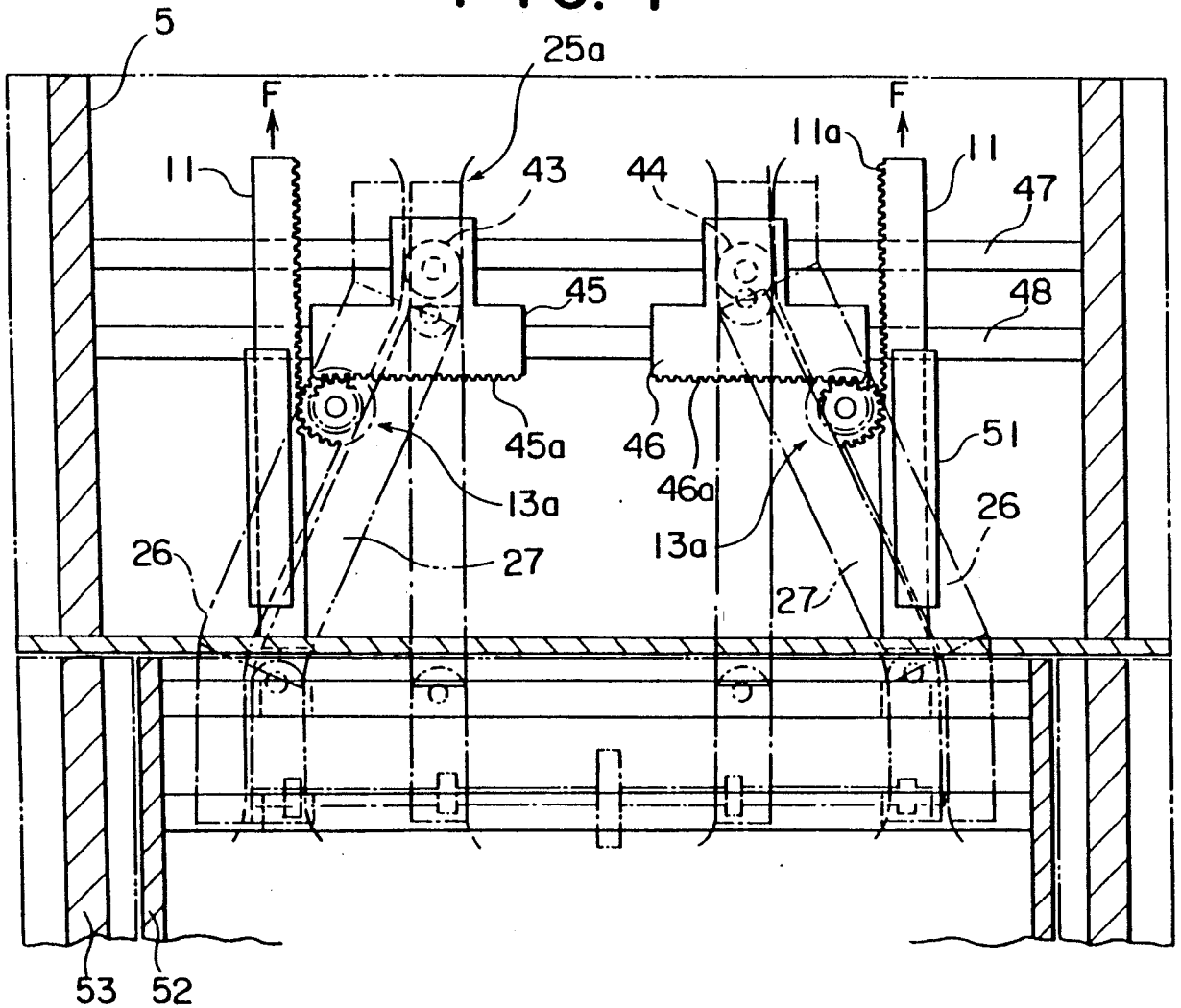
FIG. 7 is a sectional plan view of the convertible step illustrated in FIG. 5 with the fork in its inactuated retracted position.
Figure 15:
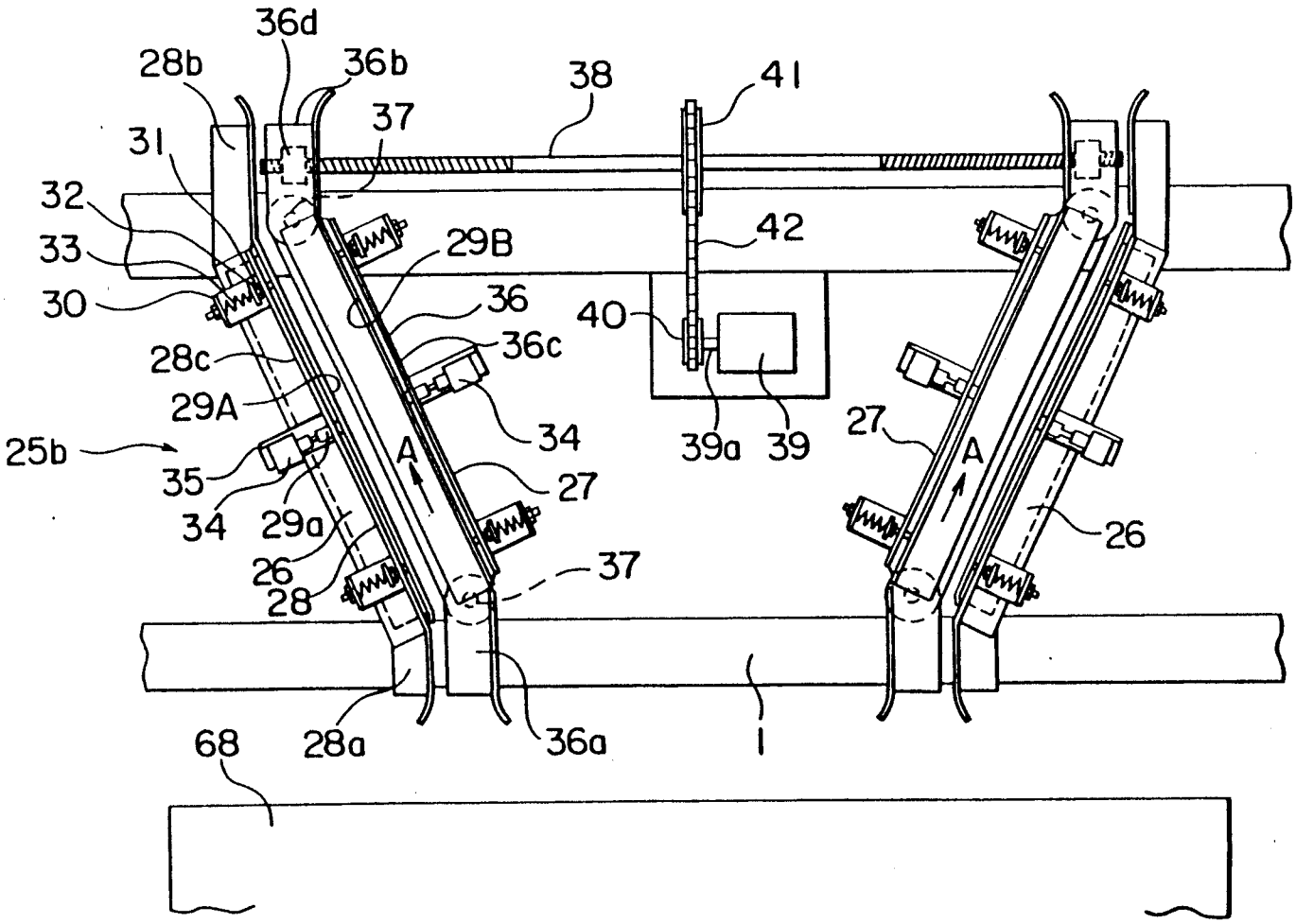
FIG. 15 is a plan view illustrating the upper guide rail arrangement.

Within the upper and the lower end portions 1*a* and 1*b* of the main frame 1, upper and lower guide rail units 25*a* and 25*b* are disposed. Since these guide rail units 25*a* and 25*b* are of similar construction, the description will first be made as to the lower guide rail unit 25*b*. As shown in FIGS. 6 and 15, a pair of stationary guide rails 26 are disposed at the positions widthwisely spaced apart from each other and a pair of movable guide rails 27 are disposed inside of the stationary guide rails 26.

As best seen in FIG. 15, the outer stationary guide rails 26 comprise a rail main body 28 made of an angle member attached at its opposite ends to the main frame 1. The rail main body 28 comprises a first end 28*a* close to the floor 68, a second end 28*b* on the intermediate sloped portion side and located at a position outside of the first end 28*a*, and an intermediate inclined portion 28*c* connected between the first and the second ends 28*a* and 28*b*. An outer guide member 29A which is an angle member is elastically mounted at each end thereof to the intermediate portion 28*c* of the rail main body 28 to extend over the substantially entire length of the intermediate portion 28*c*. The guide member 29A is supported by two spring supports each comprises a spring bracket 30 attached to the rail main body 28, a rod 31 with a spring seat 32 extending from the guide member 29A and a compression spring 33 disposed between the spring seat 32 of the rod 31 and the spring bracket 30. There is also provided a sensor switch 34 mounted on the main body 1 by a switch bracket 35 so that it faces the pin 29*a* secured to the guide member 29A.

The movable guide rail 27 comprises a rail main body 36 which is an angle member. The rail main body 36 has a first end 36*a* close to the floor 68 securely attached to the main frame 1, an intermediate portion 36*c* pivotally connected by a pivot pin 37 to the first end 36*a* and a second end 36*b* pivotally connected by another pivot pin 37 to the free end of the intermediated portion 36*c*. The second end 36*b* has a nut 36*d* which is threadably engaged with one end of a lead screw 38 connected to a drive motor 39 through a shaft 39*a*, sprocket wheels 40 and 41 and a chain 42 wound around the sprocket wheels 40 and 41. An inner guide member 29B similar to the outer guide member 29A is elastically mounted to the intermediate portion 36*c* of the movable guide rail 27 by the similar spring support arrangement. A detector element 34 similar to that disposed on the stationary guide rail 26 is mounted between the guide member 29B and the intermediate portion 36*c* of the movable guide rail 27.

When the drive motor 39 is rotated, the lead screw 38 is rotated through the sprocket wheels 40, 41 and the chain 42, so that the second ends 36*b* of the movable guide rail 36 are moved widthwise of the escalator steps. Thus, the movable guide rails 36 can be selectively shifted according to the direction of rotation of the motor 39 between a wheel chair carrying mode illustrated in FIG. 15 in which the movable ends 36*b* of the movable ride rails 36 are separated and the movable guide rails 36 are positioned to extend along the slanted stationary guide rails 26 and an ordinary operation mode in which the movable ends 36*b* of the movable guide rails 36 are located relatively close to each other so that the movable guide rails 36 extend in parallel to each other in the direction of travel of the escalator steps.

Figure 16:
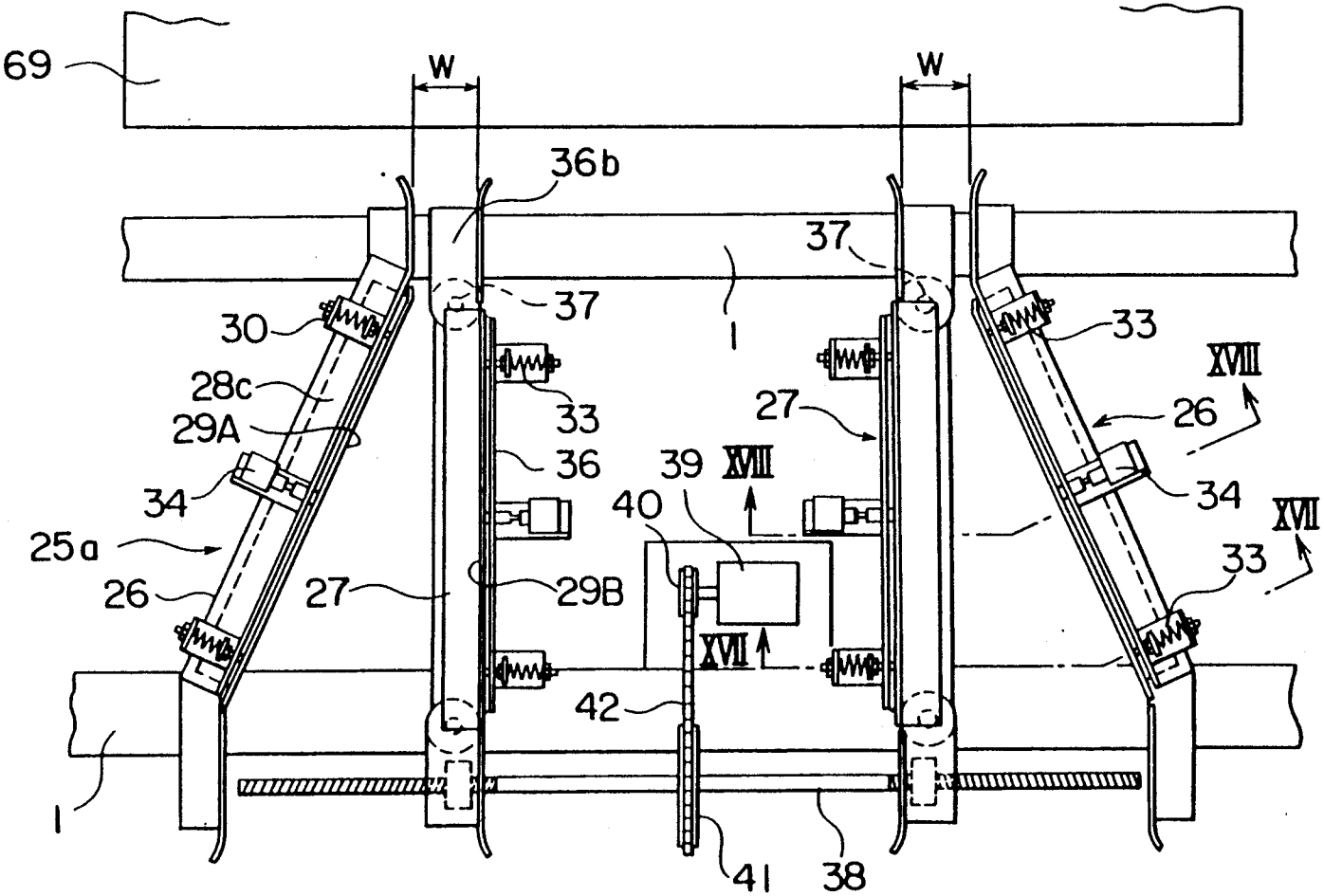
FIG. 16 is a plan view illustrating the lower guide rail arrangement.
Figure 17:
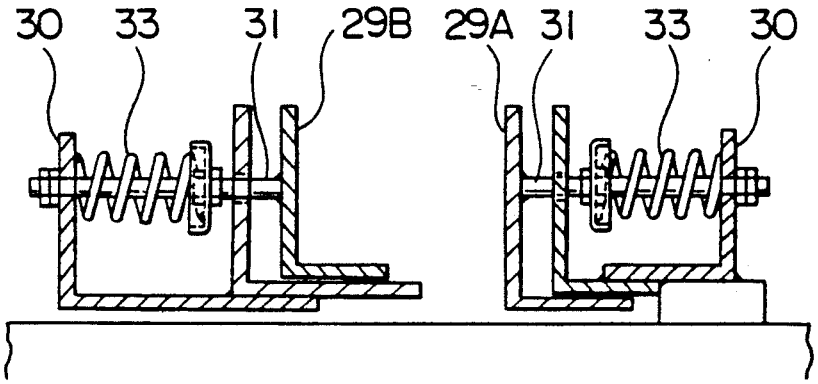
FIG. 17 is a cross-sectional view taken along line XVII—XVII of FIG. 16.
Figure 18:
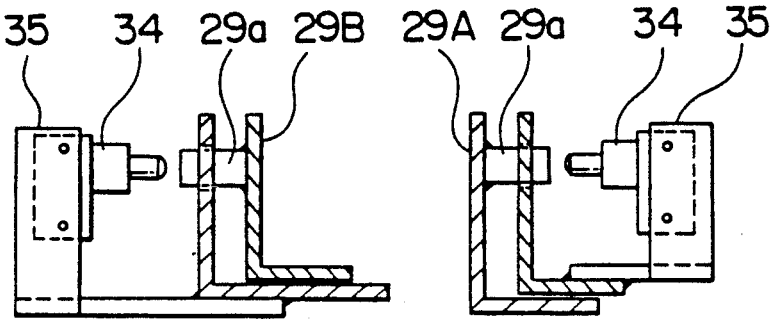
FIG. 18 is a cross-sectional view taken along line XVIII—XVIII of FIG. 16.

The escalator system also comprises an upper guide rail unit 25*a* at the upper end portion of the main frame 1 in conjunction with an upper floor 69 as illustrated in FIG. 16. The upper guide rail unit 25*a* has a structure quite similar to that illustrated and described in conjunction with FIG. 15.

Figure 5:
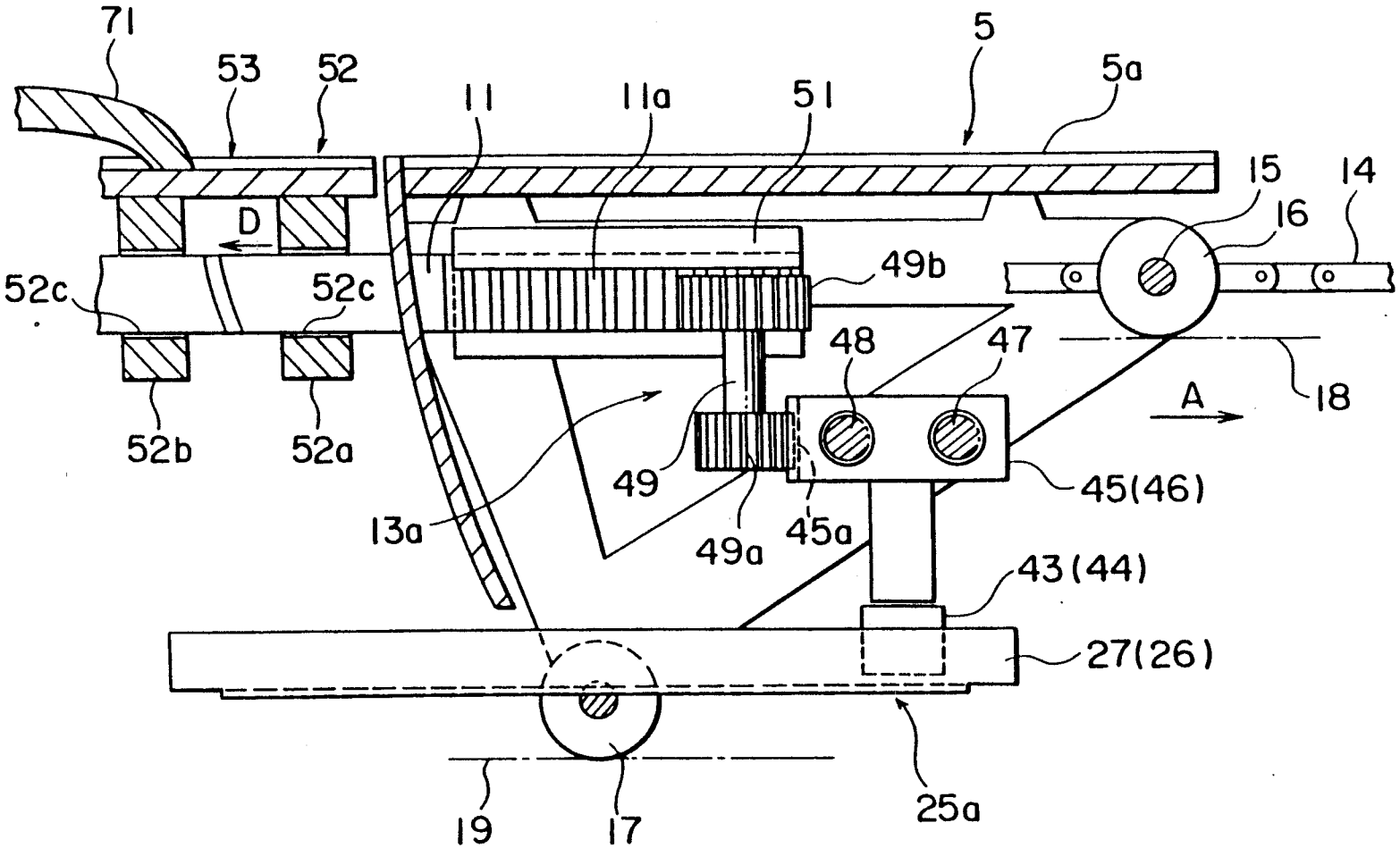
FIG. 5 is an enlarged sectional side view of the convertible step with the fork.

As illustrated in FIG. 5, the convertible step 5 provided with the form has rotatably mounted thereon guide rollers 43 and 44 mad of rubber between the stationary and the movable guide rail 26 and 27 on both sides. The rollers 43 and 44 are arranged to transmit a movable member or drive force to forks 11 of each side through a drive force transmission mechanism 13*a*.

That is, the drive force transmission mechanism 13*a* comprises movable 45 and 46 connected to the guide roller 43 and 44 through vertical axles secured to the movable elements 45 and 46. The movable elements 45 and 46 are slidably supported by two shafts 47 and 48 horizontally extending widthwise in the step 5 and having formed thereon racks 45*a* and 46*a* extending in the direction of width of the step 5. The drive force transmission mechanism 13*a* also comprises pinions 49*a* and 50*a* as well as pinions 49*b* and 50*b* secured on the lower and the upper ends of the shafts 49 and 50 rotatable supported to the step 5 by an unillustrated bearings. The pinions 49*a* and 50*a* engage with the widthwise racks 45*a* and 46*a* on the movable elements 45 and 46. The drive force transmission mechanism 13*a* further comprises two forks 11 slidably mounted to the step 5 by fork guides 51 and having formed thereon racks 11*a* to which the pinions 49*b* and 50*b* engage. The forks 11 can be slidably moved between an extended position and a retracted position. In the extended position, the forks 11 are projected from the rear end of the convertible step 5 and inserted into openings 52*c* formed in front and rear fork brackets 52*a* and 52*b* secured to a movable tread board 52*d* of the movable step 52 of the convertible step 6. In the retracted position, the forks 11 are withdrawn from the fork brackets of the convertible step 6 and contained under the tread board 5*a* of the convertible step 5.

Figure 8:
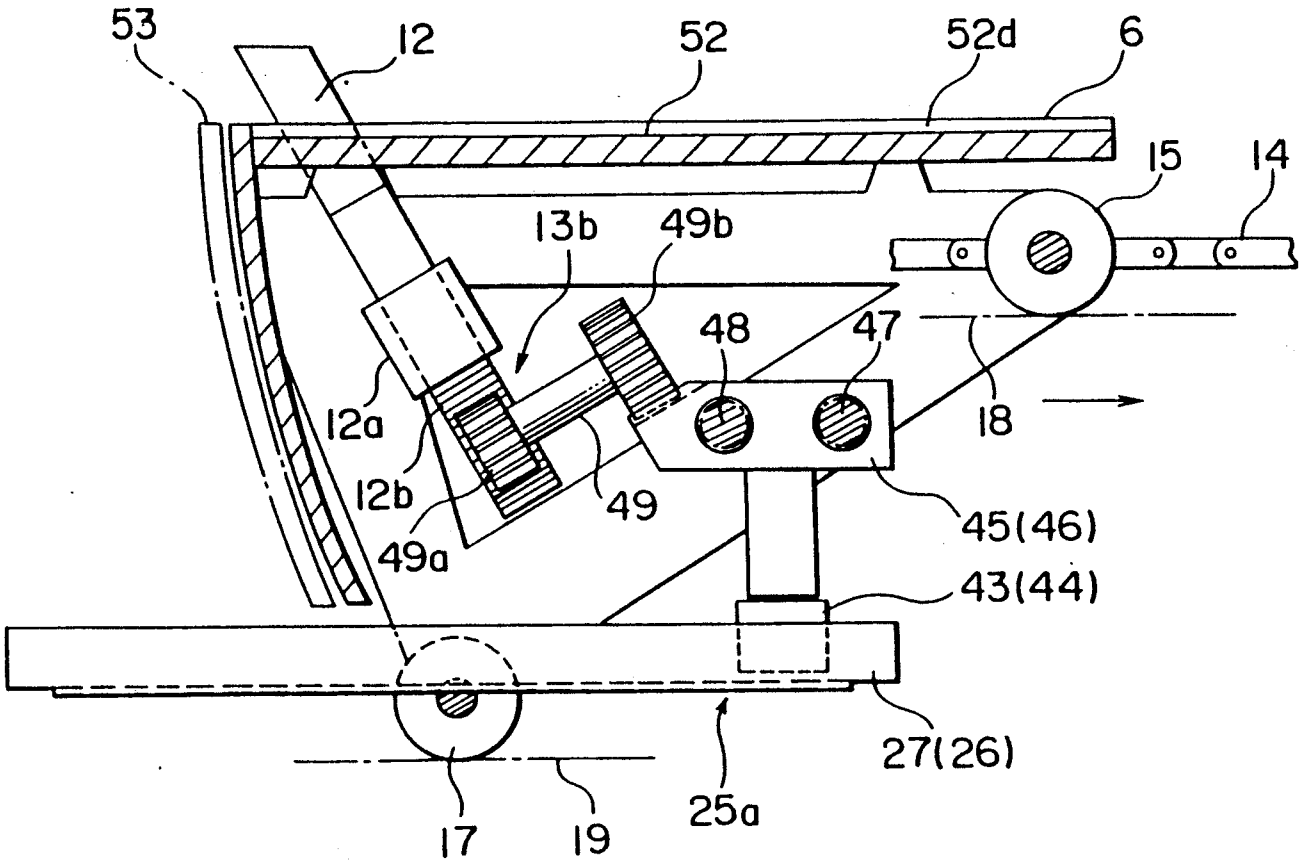
FIG. 8 is an enlarged sectional side view of the convertible step with the wheel stopper.
Figure 9:
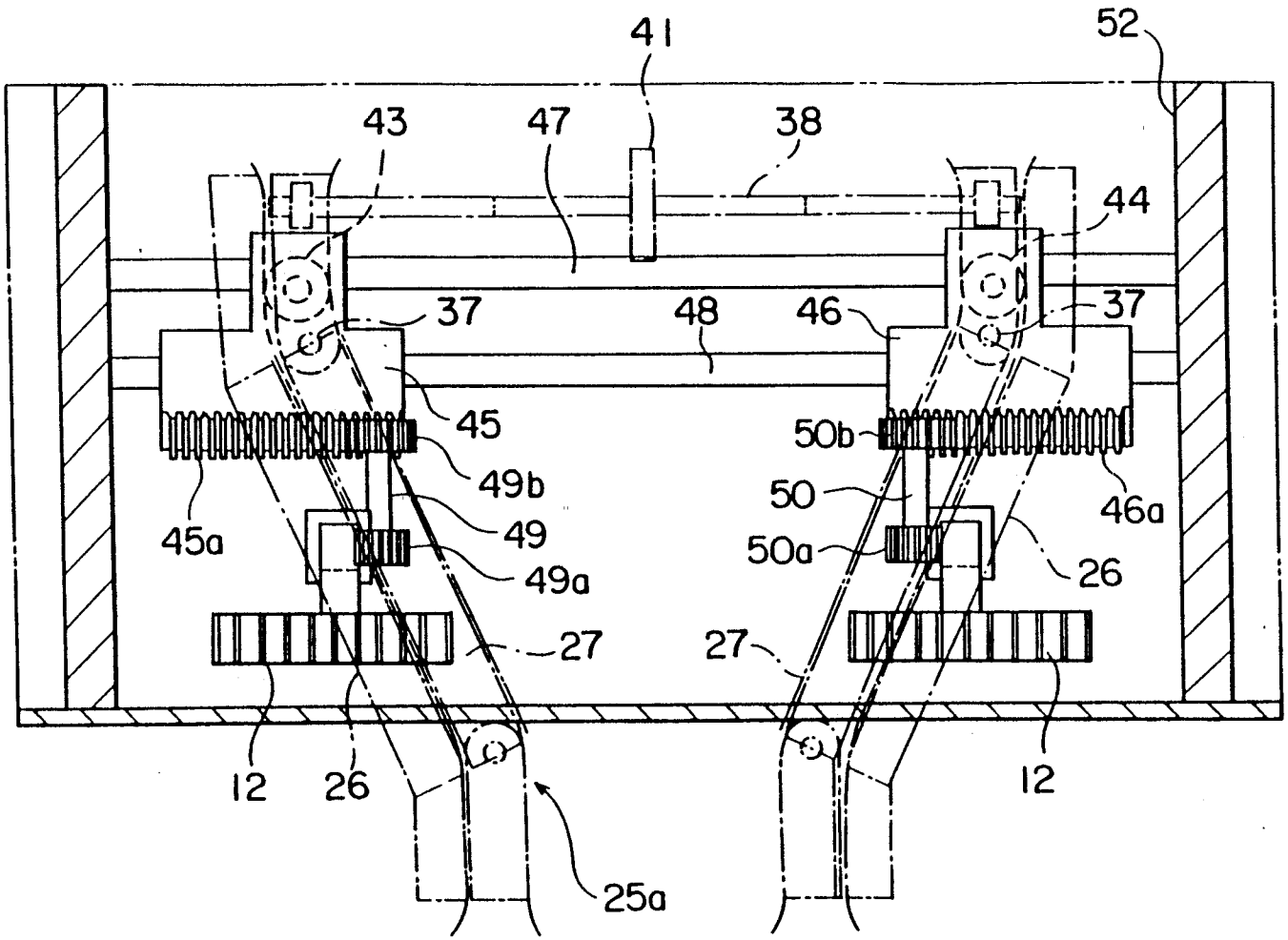
FIG. 9 is a sectional plan view of the converted step illustrated in FIG. 8 with the wheel stopper in its actuated projecting position.
Figure 10:
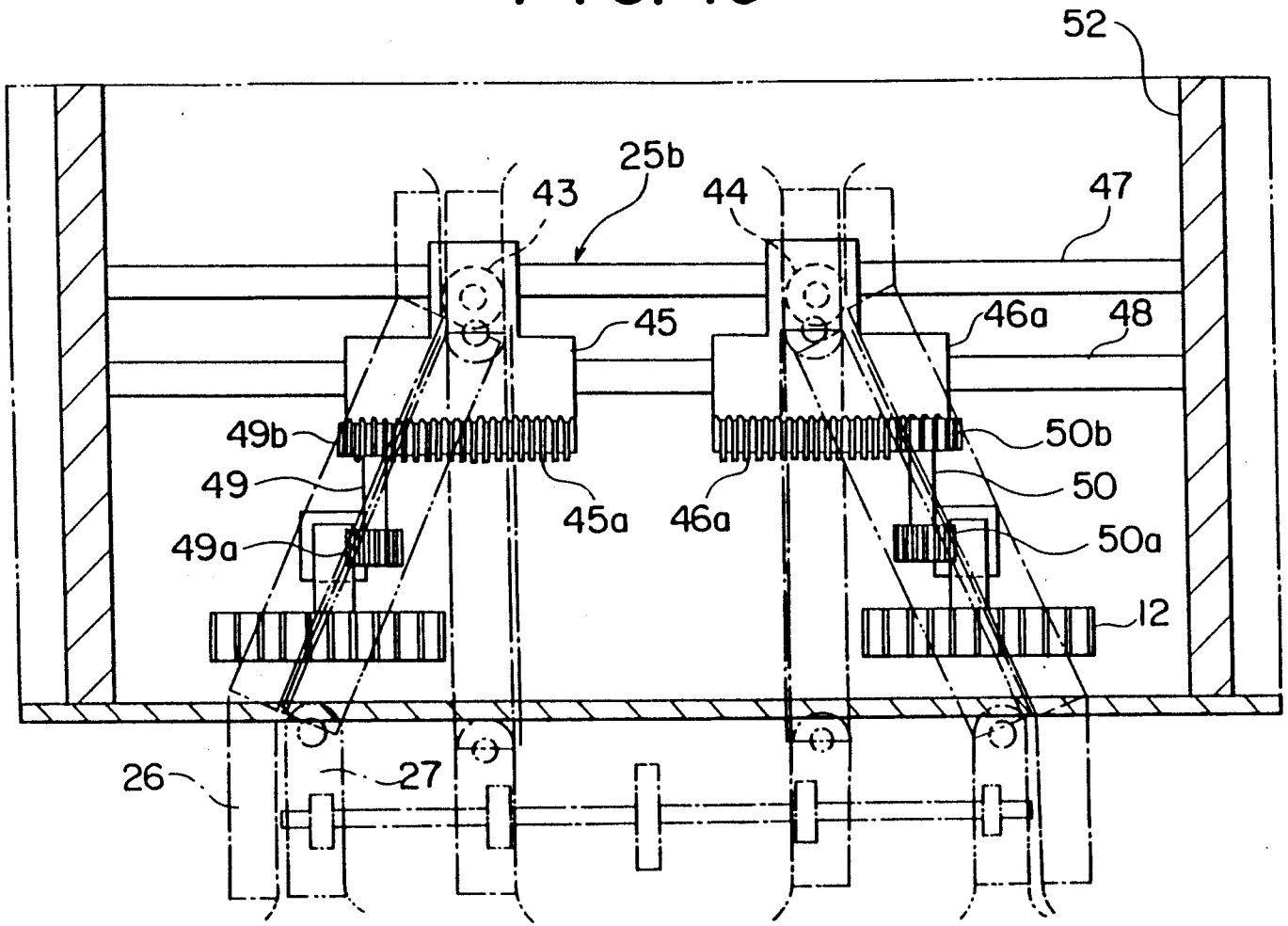
FIG. 10 is a sectional plan view of the converted step illustrated in FIG. 8 with the wheel stopper in its inactuated retracted position.

As illustrated in FIG. 8, the convertible step 6 comprises a step main body 53 which supports the movable step 52 in such a manner that the movable step 52 can be elevated from the main body 53. The movable step 52 has a movable riser extending downwardly from the rear end of the movable tread board 52*d* along the inner surface of the riser of the step main body 53. The convertible step 6 also comprises a wheel stopper 12 which can be moved between a projected position illustrated in FIG. 8 and a retracted position, and a drive force transmission mechanism 13 for actuating the wheel stopper 12 between the projected position and the retracted position. The drive force transmission mechanism 13*b* of the convertible step 6 is of generally similar construction to the drive force transmission mechanism 13*a* of the convertible step 5, and comprises rubber guide rollers 43 and 44 attached to the movable elements 45 and 46 slidable along guide rails 47 and 48 and having widthwise rack, pinions 49*a* and 49*b* connected by axles 49 rotatably supported by bearings (not shown) mounted to the step main body 53 and a pair of wheel stoppers 12 slidably supported by bearings 12*a* to the main body 53.

Figure 11:
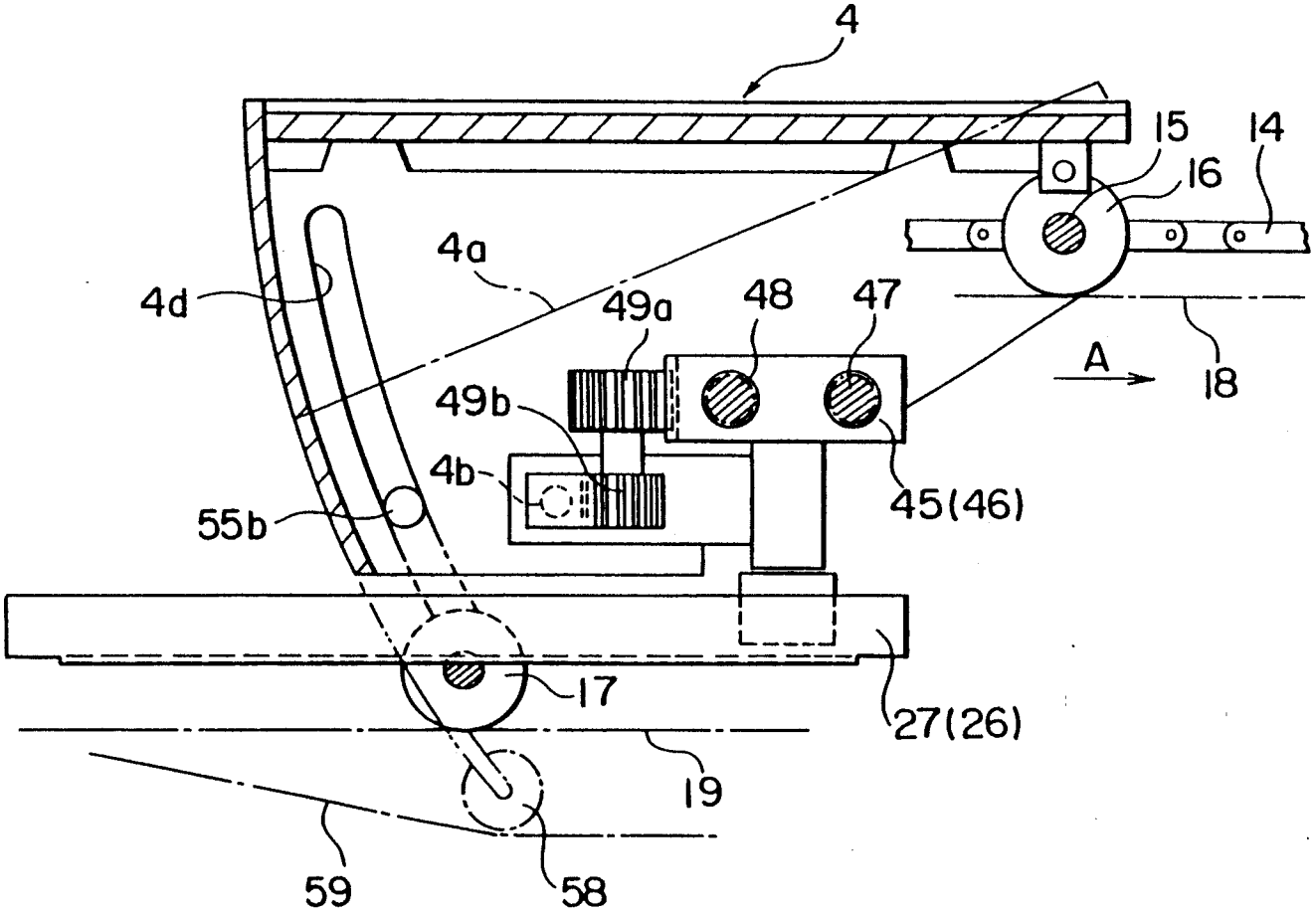
FIG. 11 is an enlarged sectional side view of the convertible step with the drop-down tread board.
Figure 12:
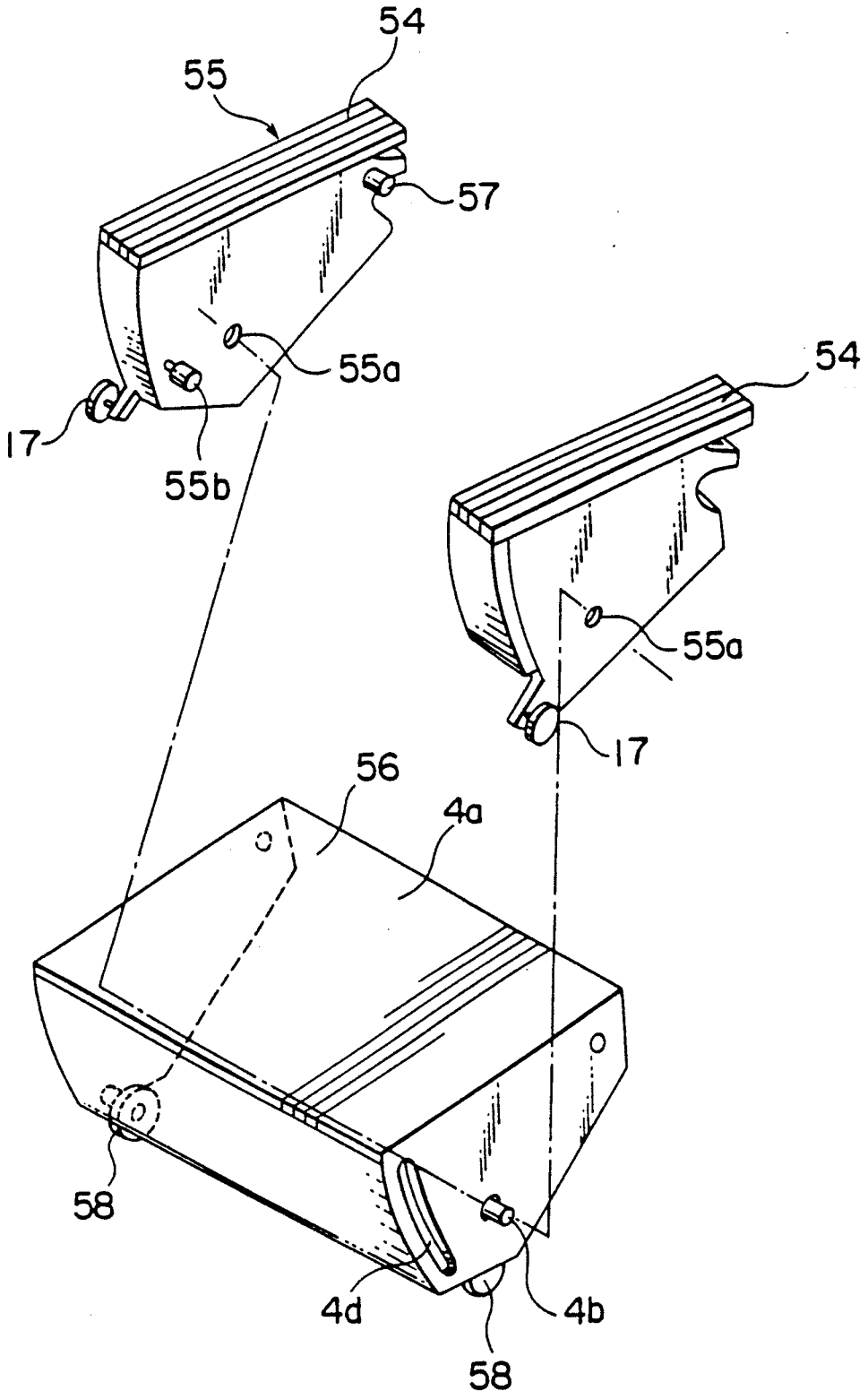
FIG. 12 is a perspective exploded view the drop-down step illustrated in FIG. 11.
Figure 13:
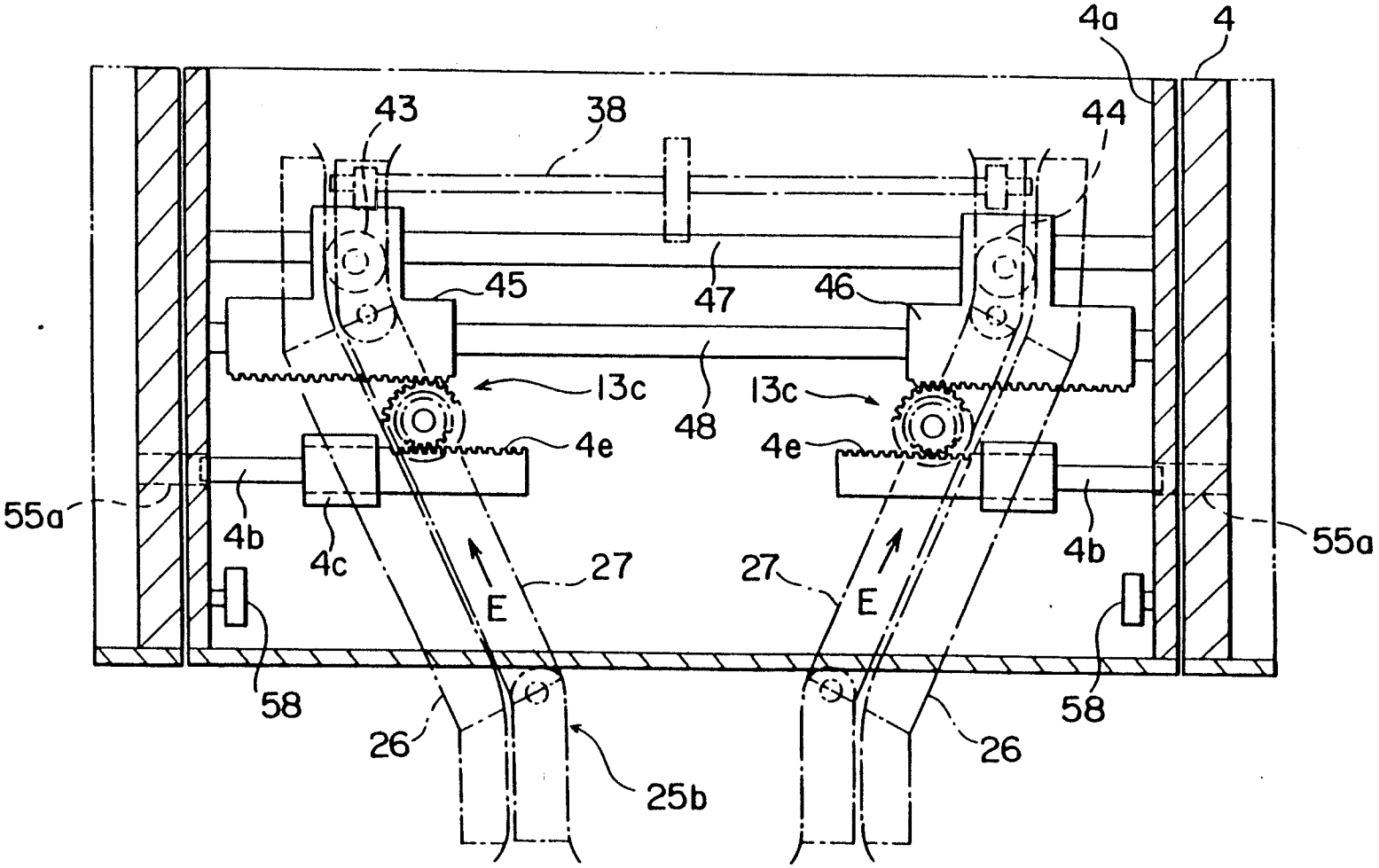
FIG. 13 is a sectional plan view of the converted step illustrated in FIG. 11 with the drop-down tread board in its inactuated, horizontal position.
Figure 14:
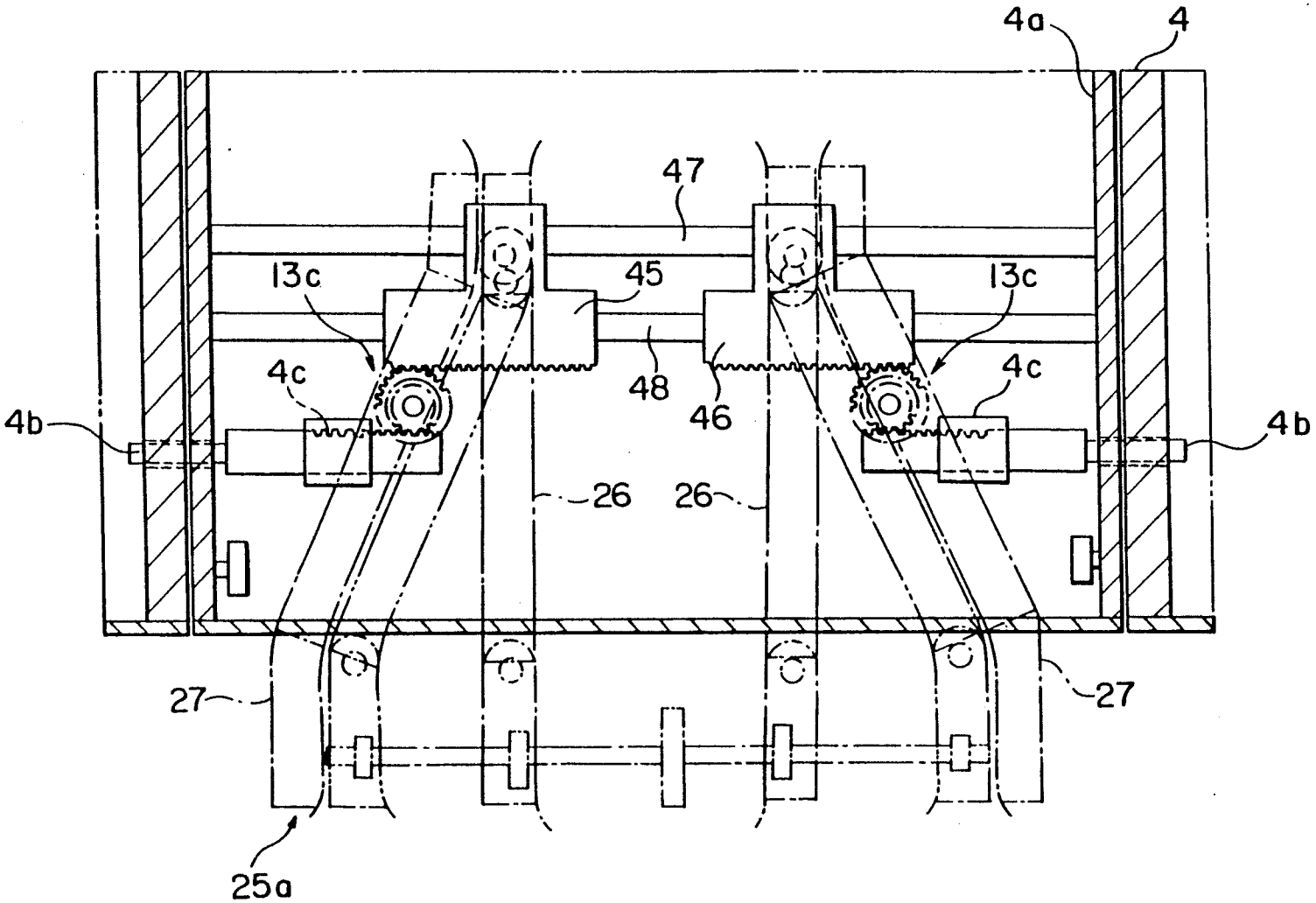
FIG. 14 is a sectional plan view of the converted step illustrated in FIG. 11 with the drop-down tread board in its actuated, sloped position.

As illustrated in FIGS. 11 and 12, the drop-down convertible step 4 with a tiltable tread board comprises a step main body 55 having a pair of side members including a horizontal tread 54 and a drop-down tread 56 tiltably supported between the main body side members 55 by pins 57. The drop-down tread 56 has a movable tread board 4*a* which defines a flat tread surface together with the horizontal treads 54 on the side members 55. The side faces of the drop-down tread 56 have a pair of holder rods 4*b* slidably supported by bearings 4*c* (FIG. 13) attached to the tread 56 so that the holder rods 4*b* are retractable with respect to side surfaces of the drop-down tread 56. The side faces of the drop-down tread 56 also have a pair of arcuated cam grooves 4*d* extending along an arc formed about the pivot pins 57. The drop-down tread 56 has a pair of rollers 58 rotatably mounted thereon. Also, the main body side members 55 have circular holes 55*a* into which the projecting end of the holder rods 4*b* can be inserted and cam follower rollers 55*b* which can be received and cammed when the movable drop-down tread 56 and the main frame members 55 are assembled. The main body side members 55 also have guide rollers 17.

The drop-down step 4 also comprises a drive force transmission mechanism 13*c* which comprises guide rollers 43 and 44 and movable elements 45 and 46 rotatably supporting the guide rollers 43 and 44 and slidable along guide rails 47 and 48. The movable elements 45 and 46 have formed thereon a widthwise rack with which pinions 49*a* are engaged and the pinions 49*a* and pinions 49*b* are connected to each other and rotatably supported to the step main body. The holder rods 4*b* slidably supported by bearings 4*c* have connected thereto racks 4*e* which engage the pinions 49*b* so that they are extensible from the side walls of the drop-down tread 56 into the engagement holes 55*a* of the main body side members 55.

As best illustrated in FIG. 11, the rollers 58 mounted to the drop-down tread 56 are supported on guide rails 59 for dropping down the tread 56. The drop-down guide rails 59 extend at the same level as the guide rail 19 for guiding the rear wheels 17 of the step main body 55 at the upper and the lower end portions 1*a* and 1*b* of the escalator main frame 1 and extend at a level lower than that of the guide rails 17.

FIG. 1 depicts a conversion switch 61 and an operating switch 62 located on each of the upper and lower end portions of the handrail.

Figure 2:
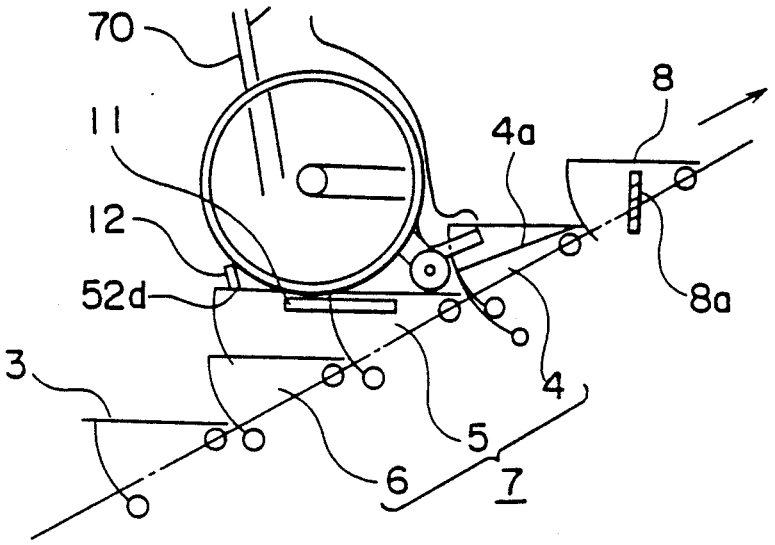
FIG. 2 is an enlarged schematic side view of the load-bearing sloped portion of the escalator system illustrated in FIG. 1.
Figure 3:
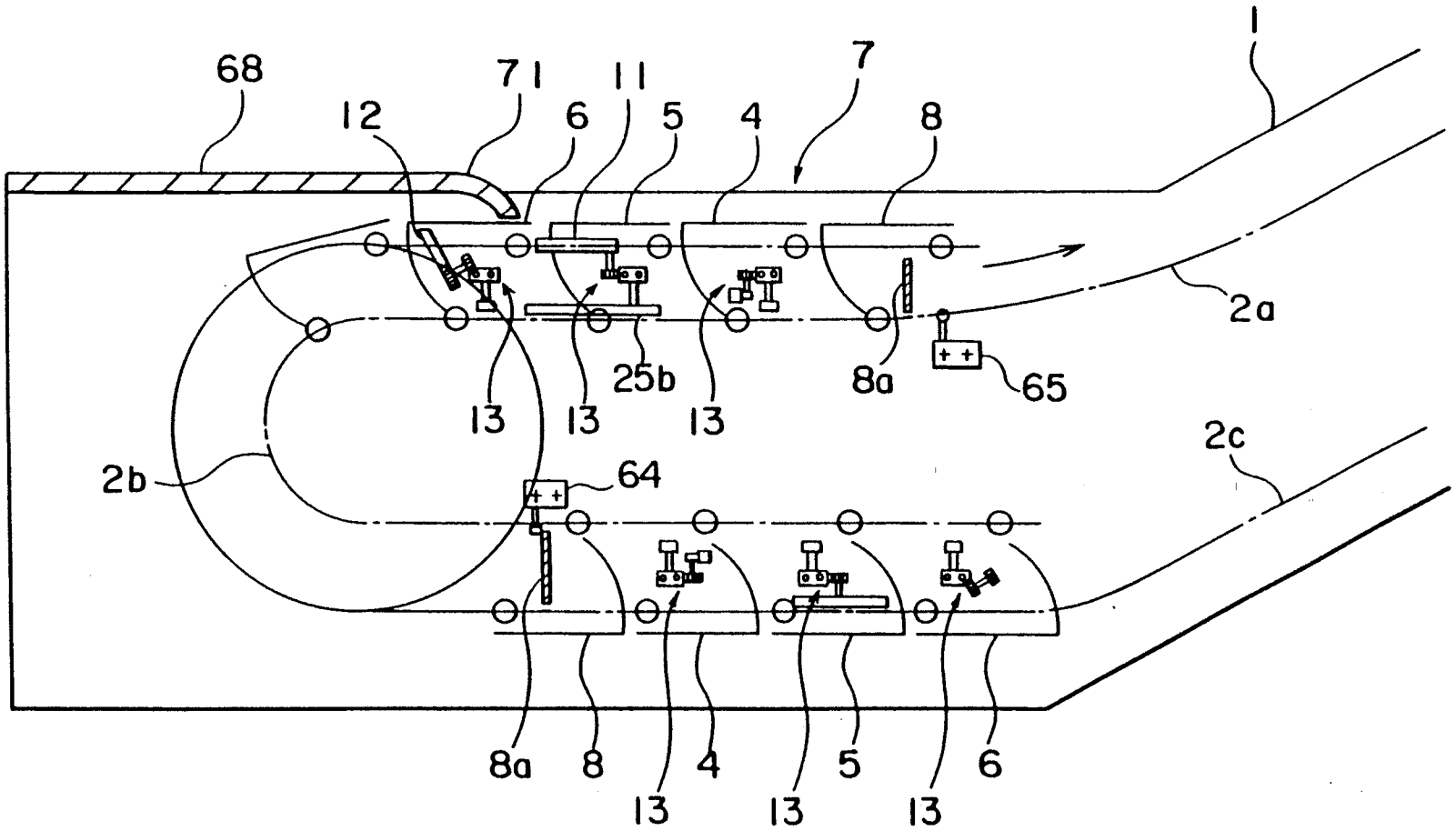
FIG. 3 is an enlarged schematic side view of the lower landing portion of the escalator system illustrated in FIG. 1.
Figure 4:
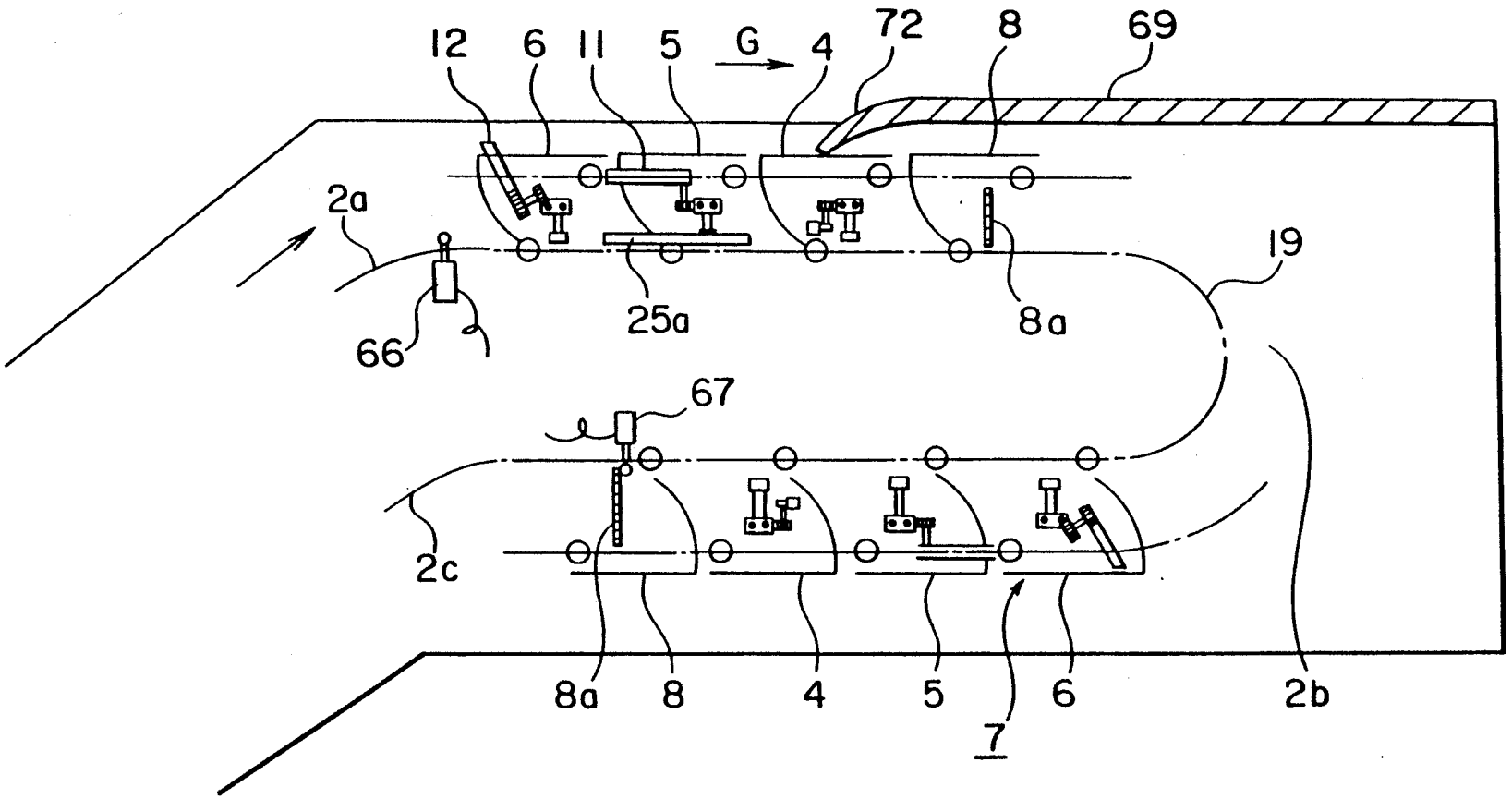
FIG. 4 is an enlarged schematic side view of the upper landing portion of the escalator system illustrated in FIG. 1.

As illustrated in FIGS. 3 and 4, a deceleration switch 64 is mounted to the main frame 1 at the lower end portion of the return run 2*c* for detecting that the convertible step unit is approaching the lower landing floor 68 and reducing the speed of the convertible step unit at the entrance for the safe and easy loading of the wheel chair 70 (FIG. 2) on the escalator from the lower landing floor 68 during the upward operation. An acceleration switch 65 is also disposed at the lower end portion of the load-bearing run 2*a* for accelerating the speed of the convertible step unit which is reduced at the lower end portion of the return run 2*c* to a normal operating speed. At the upper end portion of the load-bearing run 2*a*, a deceleration switch 66 is disposed to detect and decelerate the speed of the convertible step unit as it reaches the upper exit landing 69 and an acceleration switch 67 is disposed at the upper end portion of the return run 2c for the safe loading of the wheel chair on the escalator. In the illustrated embodiment, the switches 64 to 67 are actuated by an actuator 8a mounted to the step 8 that is connected in front of the drop-down step 4 of the convertible step unit. It is seen that the lower landing board 68 has a comb plate 71 and the upper landing board 69 has a comb plate 72.

The structure of the escalator other than that of the upper and lower guide rail units 25a and 25b, the guide rollers 43 and 44 and the drive force transmitting mechanism 13 is substantially similar to those disclosed in Japanese patent Publication No. 63-19437, Japanese Patent Laid-Open No. 63-61266 and Japanese Patent Publication No. 63-19438.

The operation of the escalator apparatus of the present invention will now be described.

When it is desired to convey the wheel chair 70 upward by the escalator apparatus of the present invention during the ascending operation, the wheel chair 70 is held on the lower landing floor 68 and the person on the wheel chair 70 or a person who assists the wheel chaired person depresses the switch 62 of the operating switch 61 for changing the mode of operation of the escalator apparatus from the normal mode to the wheel chair carrying mode. As the convertible step unit 7 including the convertible steps 4, 5 and 6 approaches the entrance or the lower landing area of the escalator apparatus, the actuator 8a on the step 8 engages the deceleration switch 64 to actuate it to decelerate the escalator apparatus through a control circuit (not shown). The control circuit also energizes the electric motor 39 of the lower guide rail unit 25b disposed on the lower end portion 1b of the main frame 1 to drive the lead screw 38 through the shaft 39a, the sprocket wheel 40, the endless chain 42 and the sprocket wheel 41. This rotation of the lead screw 38 causes the movable guide rails 27 to shift from their usual position for the ordinary mode of operation in which they extend in the direction of travel of the steps to the wheel chair carrying mode of operation (FIGS. 6 and 15) in which the movable ends of the movable guide rails 27 connected to the lead screw 38 are moved outwardly so that the movable guide rails 27 extend obliquely with respect to the direction of movement of the steps and along the stationary guide rails 26.

As the convertible steps 4, 5 and 6 are moved into this area in which the lower guide rail unit 25b is disposed, each of the guide rollers 43 and 44 of the drop-down step 4 is introduced between the stationary guide rail 26 and the movable guide rail 27 of the respective pair. The guide rollers 43 and 44 are guided or cammed by the skewed guide rail unit 25b as they move along the guide rail unit 25b so that the movable elements 45 and 46 with racks 45a and 46a are moved transversely or widthwise with respect to the step 4 along the rails 47 and 48. This widthwise sliding movement of the racked movable elements 45 and 46 causes the rotation of the pinions 49a and 50a which are in engagement with the racks 4e formed on the slidable holder rods 4b to retract the holder rods 4b from the side main tread members 55. Since the movable portion 56 is supported in its horizontal position by the guide rollers 58 on the rails 59 at this time, the movable portion 56 of the step 4 gradually tilts or drops down as illustrated by the dot and dash line 4a in FIG. 11 as the rollers 58 moves along the guide rails 59 which is positioned at a level lower than the guide rail 19 supporting the guide rollers 17 on the side members 55 in the sloped section of the stairway.

As the convertible step 5 is moved into the area in which the lower guide rail unit 25b is disposed and the guide rollers 43 and 44 of the step 5 is introduced between the stationary guide rail 26 and the movable guide rail 27. The guide rollers 43 and 44 are guided or cammed by the skewed guide rail unit 25b as they move along the guide rail unit 25b so that the movable elements 45 and 46 with racks 45a and 46a are moved transversely or widthwise with respect to the step 5 along the rails 47 and 48. This widthwise sliding movement of the racked movable elements 45 and 46 causes the rotation of the pinions 49a and 50a which are in engagement with the racks 11a formed on the slidable forks 11. Therefore, the forks 11 are pushed out from the convertible step 5 as shown by arrows D in FIGS. 5 and 6 and inserted into teh fork brackets 52a and 52b mounted to the movable tread board 52d of the next convertible step 6.

With the convertible step unit 7 in this state, the wheel chair 70 can now be moved from the lower landing board 68 onto the tread board 5a of the convertible step 5 and the movable tread board 52d of the convertible step 6.

As the convertible step 6 is moved into the area in which the lower guide rail unit 25b is disposed and the guide rollers 43 and 44 of the step 6 are guided or cammed by the skewed guide rail unit 25b as they move along the guide rail unit 25b, the movable elements 45 and 46 with racks 45a and 46a are moved transversely or widthwise with respect to the step 6 along the rails 47 and 48. This widthwise sliding movement of the racked movable elements 45 and 46 causes the rotation of the pinions 49a and 50a which are in engagement with the racks 12b formed on the wheel stopper 12 slidably supported by the bearing 12a. Therefore, the wheel stoppers 12 are pushed out from the tread surface 52d of the step 6 as illustrated in FIG. 8.

As the convertible step unit 7 leaves the horizontal section of the step travel path in which the lower guide rail unit 25b is installed and moves into the sloped section of the stairway of the escalator, the acceleration switch 65 of the unillustrated control circuit (not shown) is actuated by the actuator 8a mounted on the step 8 in front of the first convertible step 4 to increase the speed of the escalator to the ordinary speed. Also, the control circuit (not shown) causes the electric motor 39 of the lower guide rail unit 25b to rotate in the direction opposite to that described in conjunction with the operation of the deceleration switch 64. Therefore, the movable guide rails 27 are returned o the original usual position in which the movable guide rails 27 extend in the direction parallel to the direction of movement of the steps.

As the convertible step unit 7 ascend the sloped section of the stairway, the movable portion 56 of the drop-down step 4 is lowered because the movable portion 56 is supported by the rollers 58 travelling along the guide rails 59 lower than the guide rails 19 which support the rollers 17 of the main step portion 55. Also, as the second step 5 and the third step 6 ascend the sloped section of the stairway, the third step 6 is lowered relative to the second step 5. However, the movable tread board 52d remains in the same plane as that of the tread board 5a of the second convertible step 5 as illustrated in FIG. 2 because it is supported by the forks 11 projecting from the second step 5.

When the convertible step unit 7 converted into the wheel chair carrying configuration and carrying the wheel chair 70 thereon approaches the upper horizontal exit section of the stairway or the upper landing floor 69, the deceleration switch 66 is actuated by the actuator 8*a* of the actuator step 8 disposed in front of the first convertible step or the drop-down step 4. Then, the deceleration switch 66 causes the control circuit (not shown) to decrease the travel speed of the steps of the escalator apparatus and to rotate the electric motor 39 of the upper guide rail unit 25*a* disposed on the upper end portion 1*a* of the main frame 1 to drive the lead screw 38 through the shaft 39*a*, the sprocket wheel 40, the endless chain 42 and the sprocket wheel 41. This rotation of the lead screw 38 causes the movable guide rails 27 to shift from the wheel chair carrying mode of operation (FIGS. 7 and 16) in which the movable ends of the movable guide rails 27 connected to the lead screw 38 are widely separated and substantially parallel to the stationary guide rails 26 to the usual position for the ordinary mode of operation (FIG. 16) in which they extend in the direction of travel of the steps.

As the convertible steps 4, 5 and 6 are moved into this upper horizontal area in which the upper guide rail unit 25*a* is disposed, each of the guide rollers 43 and 44 of the drop-down step 4 is introduced between the stationary guide rail 26 and the movable guide rail 27 of the respective pair. The guide rollers 43 and 44 are guided or cammed by the skewed guide rail unit 25*a* as they move along the guide rail unit 25*a* so that the movable elements 45 and 46 with racks 45*a* and 46*a* are moved transversely or widthwise with respect to the step 4 along the rails 47 and 48. This widthwise sliding movement of the racked movable elements 45 and 46 causes the rotation of the pinions 49*a* and 50*a* which are in engagement with the racks 4*e* formed on the slidable holder rods 4*b*. The holder rods 4*b* are then extended outwardly from the movable portion 56 and now can be inserted into the locking holes 55*a* formed in the side main tread members 55 because the movable portion 56 and the main side members 55 are in alignment.

As the convertible step 5 is moved into the upper horizontal area in which the upper guide rail unit 25*a* is disposed, the guide rollers 43 and 44 of the step 5 are introduced between the stationary guide rail 26 and the movable guide rail 27. The guide rollers 43 and 44 are guided or cammed by the skewed guide rail unit 25*a* as they move along the guide rail unit 25*a* so that the movable elements 45 and 46 with racks 45*a* and 46*a* are moved transversely or widthwise with respect to the step 5 along the rails 47 and 48. This widthwise sliding movement of the racked movable elements 45 and 46 causes the reverse rotation of the pinions 49*a* and 50*a* which are in engagement with the racks 11*a* formed on the slidable forks 11. Therefore, the forks 11 are pulled out as shown by arrows F in FIG. 7 from the fork brackets 52*a* and 52*b* mounted to the movable tread board 52*d* of the next convertible step 6. At this state, the movable tread board 52*d* on the convertible step 6 is returned to its original position and supported by the step main body 53, so that the forks 11 can smoothly be pulled out and the movable tread portion 52*d* does not drop onto the main body 53.

With the convertible step unit 7 in this state, the wheel chair 70 can now be moved from the tread board 5*a* of the convertible step 5 and the movable tread board 52*d* of the convertible step 6 onto the upper landing board 69.

As the convertible step 6 is moved into the area in which the upper guide rail unit 25*a* is disposed and the guide rollers 43 and 44 of the step 6 are guided or cammed by the skewed guide rail unit 25*a* as they move along the guide rail unit 25*a*, the movable elements 45 and 46 with racks 45*a* and 46*a* are moved transversely or widthwise with respect to the step 6 along the rails 47 and 48. This widthwise sliding movement of the racked movable elements 45 and 46 causes the rotation of the pinions 49*a* and 50*a* which are in engagement with the racks 12*b* on the wheel stoppers 12 to pull down the wheel stoppers 12 to retract them within the tread surface 52*d* of the step 6.

As the convertible step unit 7 leaves the horizontal section of the step travel path in which the upper guide rail unit 25*a* is installed and moves into the turn-around section of the stairway of the escalator, the acceleration switch 67 of the unillustrated control circuit (not shown) is actuated by the actuator 8*a* mounted on the step 8 in front of the first convertible step 4 to increase the speed of the escalator to the ordinary speed.

For a descending operation, the endless loop of the steps is driven in the direction opposite to that described above in conjunction with the ascending operation, and the deceleration switches 64 and 66 are to be used as the acceleration switches and the acceleration switches 65 and 67 are to be used as the deceleration switches, and the switch actuator 8*a* should be provided on the unillustrated step next to the third convertible step 6. Also, the upper and the lower guide rail units 25*a* and 25*b* should be shifted their positions so that the upper guide rail unit 25*a* drives the respective movable elements 45 and 46 of the convertible steps 6, 5 and 4 to their activated wheel chair carrying positions in the named order, and that the lower guide rail unit 25*b* drives the movable elements 45 and 46 of the convertible steps 6, 5 and 4 to their inactivated usual positions.

When it is not necessary to activate the convertible step unit 7 to carry the wheel chair, the guide rail units 25*a* and 25*b* should not be operated so that all of the convertible steps 4, 5 and 6 may be used as ordinary steps.

According to the above embodiment, even when the movable guide rails 27 of the upper guide rail unit 25*a* is not shifted during the ascending operation, the convertible steps 4, 5 and 6 can be converted from the wheel chair carrying mode into the usual mode before they are driven under the comb plate 72 of the upper landing floor 69 by the camming action of the stationary guide rail 26 which is a passive mechanism requiring no movement. Therefore, differing from the arrangement in which the conversion of the steps from the wheel chair carrying mode to the ordinary mode is achieved by an active mechanism such as an electrically driven conversion mechanism, it is not possible that any convertible steps 4, 5 and 6 collides with the comb plate 72 of the upper landing board 69 before they are converted from the wheel chair carrying configuration back to the ordinary configuration. Thus, the damages to the convertible steps 4, 5 and 6 as well as the comb plate 72 of the escalator apparatus as above-described can be prevented without the need for an additional mechanism which may become complicated, making the escalator apparatus safe, reliable and simple in structure.

Also, according to this embodiment, the upper and the lower guide rail units 25*a* and 25*b* have fixed clearances W each defined at the stationary ends of the guide rail units 25*a* and 25*b* secured to the main frame 1 between the stationary ends of the stationary guide rail 26 and the movable guide rail 27. These clearances W through which the guide rollers 43 and 44 of the convertible steps 4, 5 and 6 are passed and guided are provided at both the upper and the lower horizontal portions of the stairway, so that the guide rollers 43 and 44 and therefore the movable elements 45 and 46 are always maintained at the proper positions even during the prolonged period of ordinary operation. Therefore, it is not necessary to provide a mechanism for preventing the displacement of the gears of the convertible steps. The position of the above clearances W is not limited to that described in conjunction with the embodiment described above and illustrated in the figures, but may be anywhere in the travel path of the guide rollers 43 and 44.

When any abnormality happens, such as when the holder rods 4*b* are caught in the receiving holes 55*a* and cannot be pulled out therefrom or when the holder rods 4*b* cannot be inserted into the holes 55*a*, while the guide rollers 43 and 44 of the respective convertible steps are being cammed by the guide rails 29 during the conversion of the steps, the guide rollers 43 and 44 of the step that has not properly been converted cannot be moved by the camming action of the guide rail unit 25*a* or 25*b*, resulting in a great abnormal force exerting on the steps and/or guide rail units. This force causes the compression springs 33 of the elastic support arrangements for supporting the guide rail elements 29A to be compressed to allow the guide rail elements 29A to become elastically displaced from their home positions. This movement of the guide rail elements 29A is detected by the detection switches 34 and the detection switches 34 causes the control circuit (not shown) to stop the operation of the escalator apparatus for repair. Alternatively, the escalator can be driven backwards until the convertible step unit 7 disengages the guide rail unit 25*a* or 25*b* and restart the converting operation again by forwardly passing through the guide rail unit 25*a* or 25*b*.

Accordingly, the proper completion of the convertible step converting operation can be carried out without the need for stopping the escalator apparatus and with the detection switches of a relatively simple structure. According to the conventional arrangement disclosed in Japanese Patent Publication No. 63-23113, the converting operation of the convertible steps is carried out by stopping the convertible steps and the conversion completeness is checked and confirmed in accordance with the time needed for the operation and the completion signal through the use of a relatively complicated detecting mechanism in which a detector is mounted on each of three convertible steps and the movement amount is calculated.

Since the guide rails 26 and 27 of the guide rail units 25*a* and 25*b* are disposed generally within a horizontal plane, the space within the frame truss in the depth direction can advantageously be more efficiently utilized.

Also, since two guide rails of the guide rail units are arranged in symmetry in the horizontal plane, the horizontal shakes of the escalator steps when the guide rollers of the steps are being guided by the guide rails of the guide rail unit can be greatly reduced as compared to the case where a single guide rail is used to guide the guide rollers of the steps. This is because a horizontal shaky movement of the step due to the curved portion of either one of the guide rails can be suppressed by the other of the guide rails. Therefore, the escalator steps can be driven smoothly even through the area in which the conversion of the convertible steps are achieved.

While the escalator apparatus of the above embodiment is arranged to decelerate when the wheel chair is to be loaded onto and unloaded from the escalator steps, the escalator apparatus of the present invention can also be arranged to come to a halt during the loading and unloading of the wheel chair. Also, the drop-down step 4 provided with the drop-down tread board may be omitted when a sufficient space for carrying the wheel chair can be obtained.

Further, each pair of the upper and the lower guide rail units may be arranged to have two movable guide rails instead of one stationary guide rail and one movable guide rail if it is desired.

Also, the escalator apparatus of the present invention may comprise an intermediate guide rail disposed between the upper and the lower guide rail units 25*a* and 25*b* for substantially continuously connecting them. The intermediate guide rails are useful for preventing the guide rollers and the movable elements from undesirably moving widthwise due to vibrations or the like during the travelling of the steps. The intermediate guide rails may be replaced with lock pins.

Further, the drive force transmitting mechanism, which is a rack-and-pinion mechanisms in the above-described embodiment, may be replaced with a mechanism including a chain and sprocket wheels. Also, the movable guide rail units may include a movable portion which is rotatable or elevatable. Furthermore, the present invention can be equally applicable to the escalator apparatus having a convertible step unit of different structure such as the unit that has different number of the convertible steps, the convertible step including only one movable member and that has the movable element of he different structure.

Figure 19:
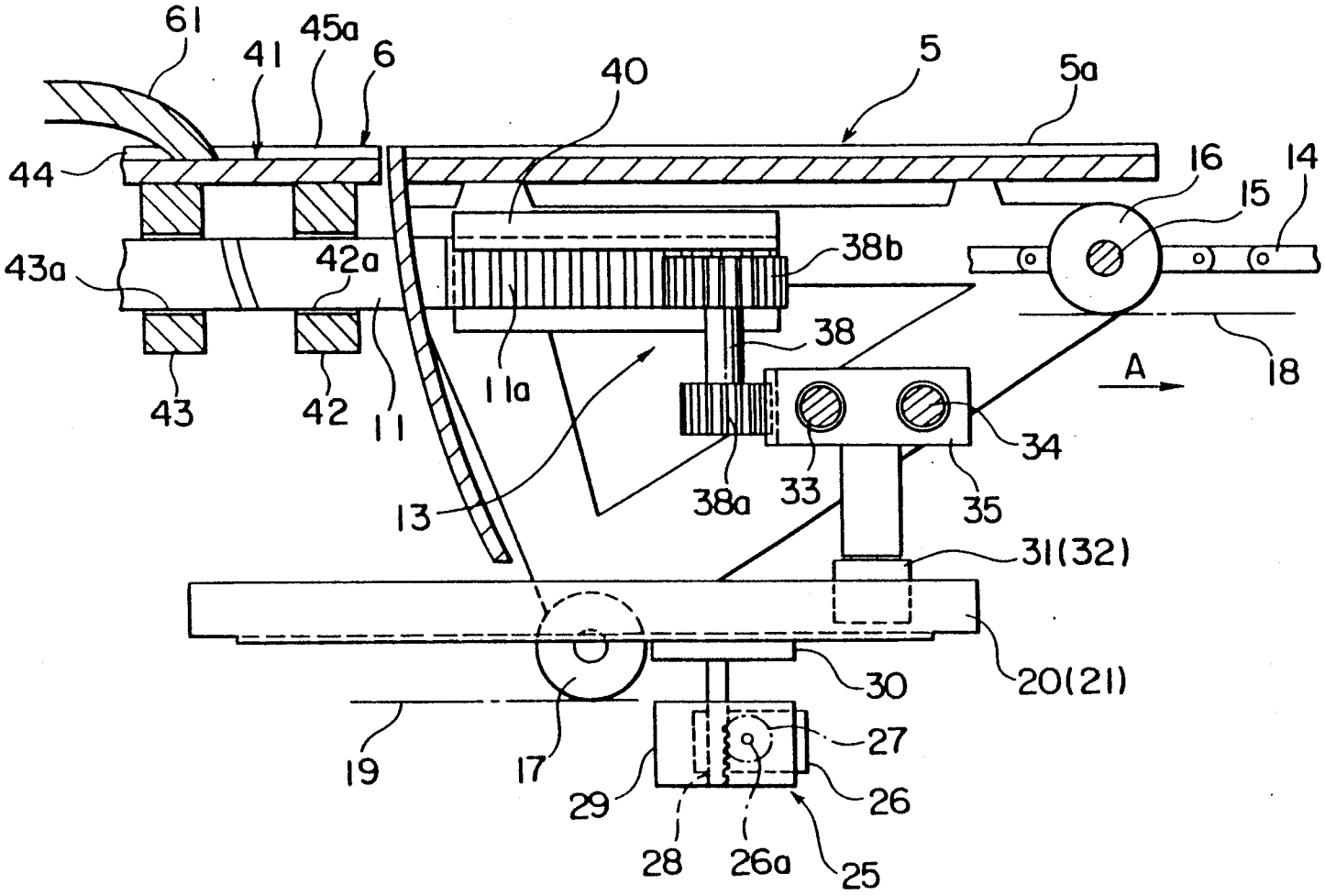
FIG. 19 is an enlarged sectional side view of the convertible step with the fork of the escalator system of another embodiment of the present invention.
Figure 20:
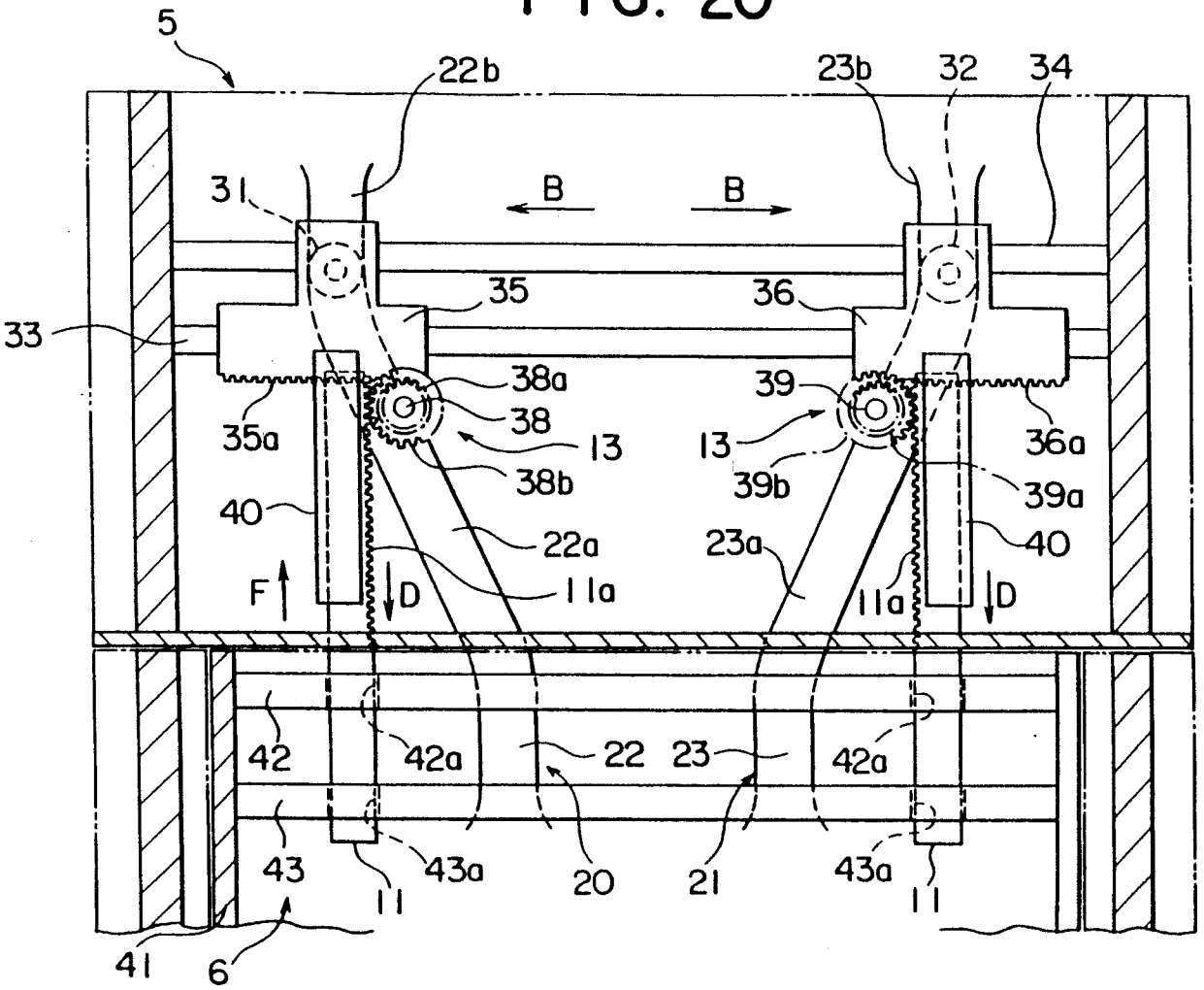
FIG. 20 is a sectional plan view of the convertible step illustrated in FIG. 19 with the fork in its actuated extended position.

FIGS. 19 and 20 illustrate another embodiment of the escalator apparatus of the present invention in which upper and the lower guide rail units 120 and 121 disposed in the upper and the lower horizontal sections of the escalator main frame 1 for converting the convertible step unit 7 has a structure different from that of the guide rail units 25*a* and 25*b* described in conjunction with the previous embodiment.

Each of the guide rail units 120 and 121 comprises a pair of guide rails 122 and 123 of a substantially U-shaped cross section and disposed generally in a horizontal plane such that the distance between the guide rails 122 and 123 at one end is different from that at the other end. More particularly, the guide rails 122 and 123 comprise narrow gauge sections 122*a* and 123*a* extending in parallel to the direction of movement of the steps, wide gauge sections 122*b* and 123*b* parallel to the narrow gauge sections 122*a* and 123*a*, and diagonal camming sections 122*c* and 123*c* connected between the narrow and the wide gauge sections.

The guide rail units 120 and 121 also comprises an actuator mechanism 125 for selectively moving up and down the guide rails 122 and 123 according to the mode of operation of the escalator apparatus. That is, the guide rails 122 and 123 can be moved into an inactuated, lower normal position in which the escalator steps including convertible steps 4, 5 and 6 are not brought into engagement with the guide rail units 120 and 121 at their guide rollers 43 and 44 and allowed to serve as ordinary escalator steps, or the guide rails 122 and 123 can be moved into an actuated, elevated position in which the guide rollers 43 and 44 of the convertible steps 4, 5 and 6 are guided or cammed by the guide rails 122 and 123 to drive the respective movable parts of the convertible steps 4, 5 and 6. The actuator mechanism 125 comprises a mounting plate 130 extending between the guide rails 122 and 123 for supporting them, a rack rod 128 connected to the mounting plate 130 and slidably supported by a bearing 29, a pinion 127 engaged with the rack rod 128 and an electric motor 126 for driving the pinion 127.

As has been described, the escalator system of the present invention comprises a main frame defining a circulating loop path therein, a plurality of steps connected in an endless step loop disposed in the loop path and a convertible step unit disposed in the step loop and having a movable member. The convertible step unit defines at least one of the steps with the movable member in an ordinary position in an ordinary operating mode, and the step unit defining a convertible step having a broad tread surface with the movable member displaced in a broad step position in a convertible operating mode. A displacement mechanism having one end engageable with the convertible step unit is disposed for displacing the movable member of the convertible step unit between the ordinary position and the broad step position by a drive force of the step loop which is a drive force component in the direction of width of the step. The other end of the displacement mechanism is engageable with a guide rail only in the spacial operating mode for moving the displacement mechanism in the step width direction by a camming action of the guide rail.

The displacement mechanism may comprise a movable body having one end engageable with the guide rail to be displaced in the width direction of the step, and a drive force transmission mechanism, having one end engageable with the movable body and the other end engageable with the movable member of the convertible step unit, for being rotated by the displacement of the movable body in the step width direction to cause the displacement of the movable member.

In a preferred embodiment of the present invention, the convertible step unit may comprise a first convertible step for defining the broad tread surface with a first movable member displaced, a second convertible step disposed adjacent to an upper level side of the first step for defining an inclined tread surface with a second movable member displaced. The convertible step unit may further comprise a third convertible step having a main body and a tread board liftably mounted to the main body, a fourth convertible step disposed adjacent to the upper side of the third convertible step and causing a displacement of the movable member for defining a flat broad tread surface together with the tread board of the third convertible step.

The guide rail may be translatingly movable into and out of engagement with the other end of the displacement mechanism in the broad tread operation mode, or may be rotatably movable into and out of engagement with the other end of the displacement mechanism in the broad tread operation mode.

Accordingly, the escalator system of the present invention has a higher operating efficiency and has no need for stopping for automatic conversion between two operational modes with a relatively simple and reliable structure.

What is claimed is:

1. An escalator system comprising:

a main frame defining a circulating loop path;

a plurality of steps connected in an endless step loop disposed in said loop path;

a convertible step unit disposed in said step loop, at least one step in said unit having a movable member disposed in a first position during an ordinary operating mode and disposed in a second position during a special operating mode;

a displacement mechanism, associated with the movable member and connected to said convertible step unit, for displacing the movable member of said convertible step unit between the first position and the second position by a drive force of said step loop which is a drive force component in the direction of width of a step; and a movable guide rail unit engageable with said displacement mechanism during the special operating mode which moves said displacement mechanism in the step width direction by a camming action of said guide rail and converts said convertible step unit.

2. An escalator system as claimed in claim 1, wherein said displacement mechanism comprises:

a movable body having one end engageable with said guide rail unit to be displaced in the width direction of said step; and a drive force transmission mechanism, having one end engageable with said movable body and the other end engageable with said movable member of said convertible step unit, which is rotated by the displacement of said movable body in the step width direction causing the displacement of the movable member.

3. An escalator system as claimed in claim 2, wherein said convertible step unit comprises:

a first convertible step which defines a broad tread surface with a first movable member displaced; and a second convertible step disposed adjacent to an upper level side of said first convertible step for defining an inclined tread surface with a second movable member displaced.

4. An escalator system as claimed in claim 3, wherein said convertible step unit further comprises:

a third convertible step having a main body and a tread board liftably mounted to said main body; and a fourth convertible step disposed adjacent to an upper side of said third convertible step which causes a displacement of the movable member for defining a flat broad tread surface together with the tread board of said third convertible step.

5. An escalator system as claimed in claim 1, wherein a guide rail of said guide rail unit is translatingly movable into and out of engagement with said displacement mechanism in the special operation mode.

6. An escalator system as claimed in claim 1, wherein a guide rail of said guide rail unit is rotatably movable into and out of engagement with said displacement mechanism in the special operation mode.

7. An escalator system as claimed in claim 1, wherein said guide rail unit comprises a detection switch for detecting an abnormality generated in the special operation mode.

8. An escalator system as claimed in claim 1, wherein said guide rail unit prevents displacement of said movable member displacement mechanism in the step width direction.

9. An escalator system as claimed in claim 1, wherein said guide rail unit comprises a movable guide rail which engages said movable member displacement mechanism during the conversion of said convertible step unit from the ordinary operation mode to the special operation mode and displaces said movable member displacement mechanism in the step widthwise direction, and a stationary guide rail which engages said movable member displacement mechanism during the conversion of said convertible step unit in the step width direction.

10. An escalator system according to claim 1, where a movable member of one of the steps in said convertible step unit is an tiltable tread board.

11. An escalator system according to claim 1, where a movable member of one of the steps in said convertible step unit is an elevatable tread board.

12. An escalator system comprising:

a main frame defining a circulating loop path;

a plurality of steps connected in an endless step loop disposed in said loop path;

a convertible step unit disposed in said step loop, at least one step in said step unit having a movable member disposed in a first position during an ordinary operating mode and disposed in a second position during a special operating mode;

a displacement mechanism, connected to said convertible step unit, for displacing the movable member of said convertible step unit between the first position and the second position by a drive force of the step loop which is a drive force component in the direction of width of a step; and first and second movable guide rail units pivotally attached to said main frame and engageable with said displacement mechanism during the special operating mode which move said displacement mechanism in said step width direction by a camming action of said guide rail and convert said convertible step unit.

13. An escalator system according to claim 12, further comprising an actuator mechanism driven by a motor which brings said convertible step unit into engagement with said guide rails during the special operating mode.

14. An escalator system comprising a main frame defining a circulating loop path;

a plurality of steps connected in an endless step loop disposed in said loop path;

a convertible step unit disposed in said step loop, at least one step in said step unit having a movable member disposed in a first position during an ordinary operating mode and disposed in a second position during a special operating mode;

a displacement mechanism, connected to said convertible step unit, for displacing the movable member of said convertible step unit between the first position and the second position by a drive force of the step loop which is a drive force component in the direction of width of a step;

a pair of stationary guide rails rigidly attached to said main frame;

a pair of movable guide rails disposed inside said pair of stationary guide rails pivotally attached to said main frame which move said displacement mechanism in said step width direction by a camming action of said guide rails and convert said convertible step unit.

15. An escalator system according to claim 14, where the stationary guide rails and the movable guide rails include detection switches.

* * * * *